US008733355B2

(12) United States Patent
Turiello

(10) Patent No.: US 8,733,355 B2
(45) **Date of Patent: *May 27, 2014**

(54) BREATHABLE AIR SAFETY SYSTEM AND METHOD

(75) Inventor: Anthony J. Turiello, Portola Valley, CA (US)

(73) Assignee: Rescue Air Systems, Inc., San Carlos, CA (US)

( * ) Notice: Subject to any disclaimer, the term of this patent is extended or adjusted under 35 U.S.C. 154(b) by 1049 days.

This patent is subject to a terminal disclaimer.

(21) Appl. No.: 12/410,484

(22) Filed: Mar. 25, 2009

(65) Prior Publication Data

US 2009/0178675 A1 Jul. 16, 2009

Related U.S. Application Data

(63) Continuation-in-part of application No. 11/505,597, filed on Aug. 16, 2006, now Pat. No. 7,527,056.

(51) Int. Cl.
*A62B 13/00* (2006.01)
*A62B 7/02* (2006.01)

(52) U.S. Cl.
CPC .. *A62B 13/00* (2013.01); *A62B 7/02* (2013.01)
USPC ..... 128/205.26; 128/203.27; 128/204.18; 128/204.21

(58) Field of Classification Search
USPC ..... 128/200.24, 201.24, 203.27, 204.18, 128/204.21, 205.26, 897, 898; 707/101; 52/2.11–2.26, 169.6, 302.1–302.7, 52/173.1–173.3
See application file for complete search history.

(56) References Cited

U.S. PATENT DOCUMENTS

| | | | | | |
|---|---|---|---|---|---|
| 281,027 | A | * | 7/1883 | Cottier | 454/368 |
| 465,298 | A | * | 12/1891 | Timby | 165/48.1 |
| 472,163 | A | * | 4/1892 | Duffy | 454/252 |
| 835,075 | A | * | 11/1906 | Mahaffy | 128/207.12 |
| 1,055,196 | A | * | 3/1913 | Gold | 165/145 |
| 1,413,275 | A | * | 4/1922 | Howard | 116/214 |
| 2,014,840 | A | * | 9/1935 | Geiger et al. | 454/252 |
| 2,299,763 | A | * | 10/1942 | Cannaday | 312/119 |
| 2,299,793 | A | * | 10/1942 | Cannaday et al. | 128/202.13 |
| 2,855,926 | A | * | 10/1958 | Koppelman | 128/202.13 |

(Continued)

OTHER PUBLICATIONS

"NFPA 1981 Standard on Open-Circuit Self-Contained Breathing Apparatus for Fire and Emergency Services" 2002 Edition; by: National Fire Protection Association, Inc.; 52 Pages; Last Visited May 13, 2012.

(Continued)

*Primary Examiner* — Annette Dixon
(74) *Attorney, Agent, or Firm* — Raj Abhyanker, P.C.

(57) ABSTRACT

A breathable air safety system and method is disclosed. In an embodiment, a safety system of a structure includes a supply unit (100) of a structure to facilitate delivery of breathable air from a source of compressed air to an air distribution system (150, 250, 350) of the structure, a valve (408) to prevent leakage of the breathable air from the air distribution system (150, 250, 350) potentially leading to loss of system pressure, a fill station (102A) interior to the structure to provide the breathable air to a breathable air apparatus at multiple locations of the structure, and a distribution structure (104) that is compatible with use with compressed air that facilitates dissemination of the breathable air of the source of compressed air to multiple locations of the structure.

26 Claims, 18 Drawing Sheets

(56) References Cited

U.S. PATENT DOCUMENTS

| | | | | | |
|---|---|---|---|---|---|
| 3,739,707 | A | * | 6/1973 | Knapp | 454/228 |
| 3,945,800 | A | * | 3/1976 | Roos | 431/345 |
| 4,058,253 | A | * | 11/1977 | Munk et al. | 236/46 R |
| 4,153,083 | A | * | 5/1979 | Imler et al. | 141/4 |
| 4,165,738 | A | * | 8/1979 | Graves et al. | 128/202.13 |
| 4,331,139 | A | * | 5/1982 | Popa | 128/202.13 |
| 4,353,292 | A | * | 10/1982 | Almasi et al. | 454/168 |
| 4,380,187 | A | * | 4/1983 | Wicks | 454/342 |
| 4,413,622 | A | * | 11/1983 | Austin | 128/205.25 |
| 4,467,796 | A | * | 8/1984 | Beagley | 128/202.13 |
| 4,510,930 | A | * | 4/1985 | Garcia | 128/202.22 |
| 4,542,774 | A | * | 9/1985 | Stavlo | 141/1 |
| 4,862,931 | A | * | 9/1989 | Vella | 141/1 |
| 5,071,453 | A | * | 12/1991 | Hradek et al. | 96/111 |
| 5,131,269 | A | * | 7/1992 | Blosnick et al. | 73/129 |
| 5,180,063 | A | * | 1/1993 | Sakno | 206/582 |
| 5,800,260 | A | * | 9/1998 | Kao | 454/370 |
| 5,809,999 | A | * | 9/1998 | Lang | 128/200.24 |
| 5,979,440 | A | * | 11/1999 | Honkonen et al. | 128/201.21 |
| 7,204,249 | B1 | * | 4/2007 | Richey et al. | 128/204.18 |
| 7,527,056 | B2 | * | 5/2009 | Turiello | 128/205.26 |
| 2004/0261796 | A1 | * | 12/2004 | Butler | 128/205.26 |

OTHER PUBLICATIONS

"Fire and Emergency Services—NL Self-Contained Breathing Apparatus Guidance Document for Emergency Services Applications" May 2010; 7 Pages; Last Visited May 13, 2012.

"U.S. Fire Administration/Technical Report Series Special Report:Prevention of Self-Contained Breathing Apparatus Failures" USFA-TR-088; Nov. 2001; 39 Pages; Last Visited May 13, 2012.

* cited by examiner

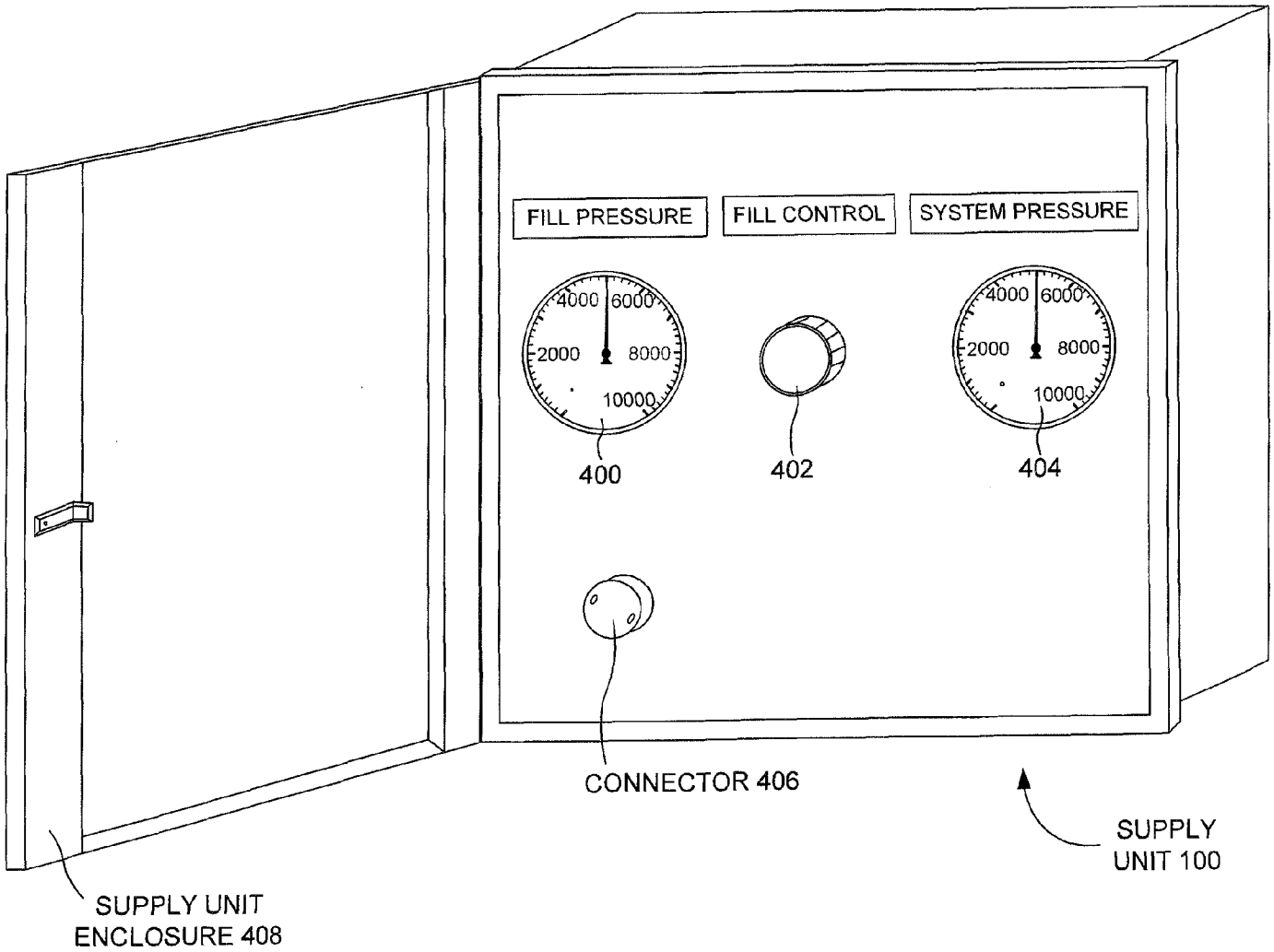
FIGURE 4A (FRONT VIEW)

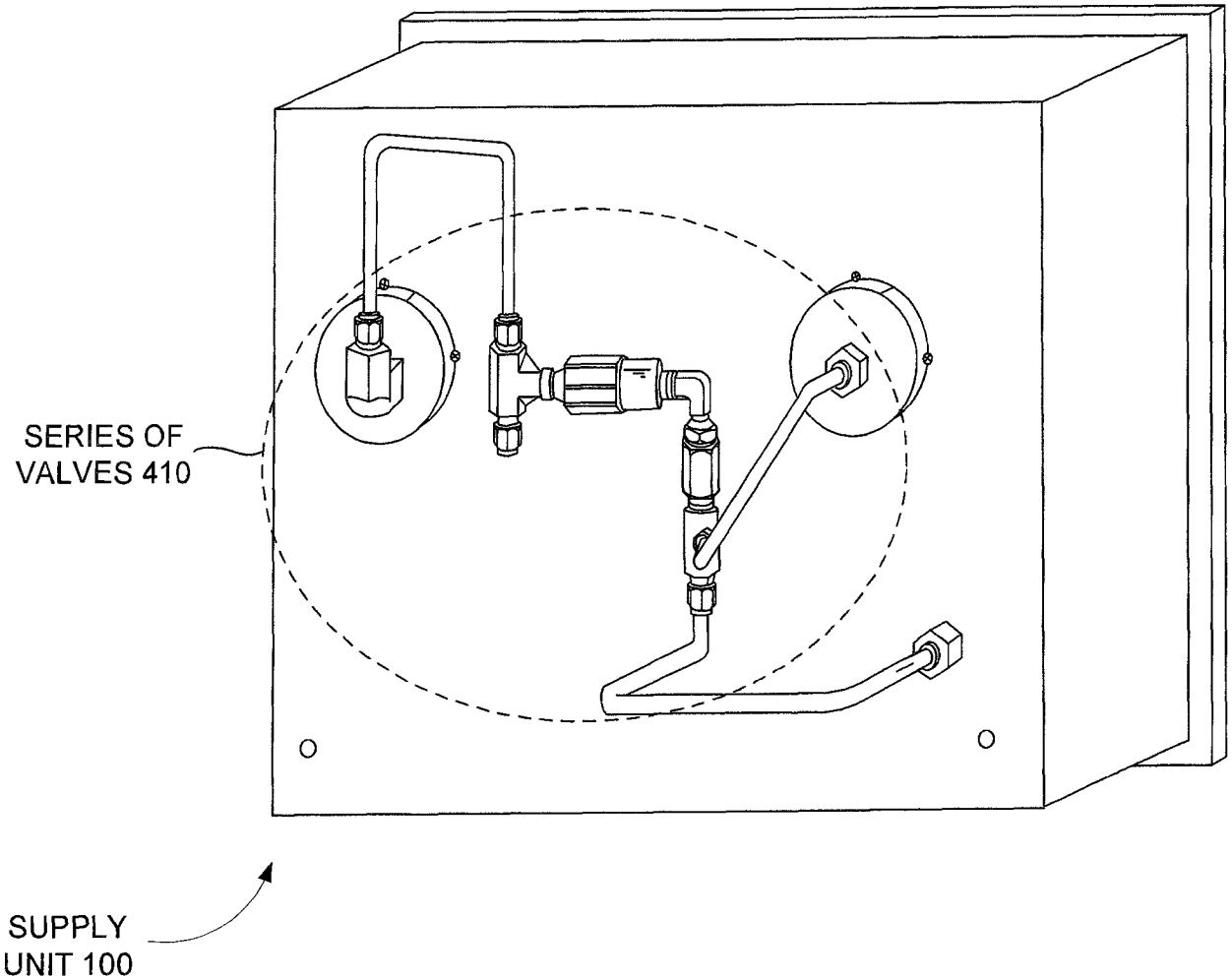
FIGURE 4B (REAR VIEW)

BREATHABLE AIR SAFETY SYSTEM AND METHOD

CLAIM OF PRIORITY

This application is a continuation-in-part of U.S. patent application Ser. No. 11/505,597 U.S. Pat. No. 7,527,056 titled "Breathable Air Safety System and Method Having an Air Storage Sub-System" filed on Aug. 16, 2006.

FIELD OF TECHNOLOGY

This disclosure relates generally to a breathable air safety system and method.

BACKGROUND

A structure may include a horizontal building structure such as a shopping mall, a warehouse, storage and manufacturing facilities, large box stores such as IKEA®, The Home Depot®, a vertical structure such as a high rise building, a mid rise building, and a low rise building, a mine, a subway, a tunnel, and/or a wine cave. A structure may also include large ships (e.g., oil tankers, cruise liners, aircraft carriers, destroyers, troop transports, ferries, etc.) and/or other vehicles (e.g., tanks, buses, cargo planes, etc.) where access to breathable air may be useful in an emergency.

The tunnel, for example, may be substantially horizontal and have a ratio of the length of the passage to the width of at least two to one. In addition, the tunnel may be completely enclosed on all sides, and the openings may be saved for the length of the covered area causing limited accessibility to the tunnel.

Providing and maintaining adequate safety in the structure may be of importance. For example, serious or fatal accidents occurring in underground mines in United States over the years may have resulted from an inability to control roofs of the underground mines. A fatal accident can occur, for example, from falling of even one large rock from the roof of the mine.

In a case of an emergency situation of the structure, emergency personnel (e.g., a fire fighter, a SWAT team, a law enforcer, and/or a medical worker, etc.) may be deployed to the structure to alleviate the emergency situation through mitigating a source of hazard as well as rescuing stranded civilians from the structure The emergency situation may include events such as a fire, a chemical attack, a terror attack, a subway accident, a mine collapse, and/or a biological agent attack.

In such situations, breathable air inside the structure may be hazardously affected (e.g., depleted, absorbed, and/or contaminated). In addition, flow of fresh air into the structure may be significantly hindered due to the structure having enclosed regions, lack of windows, and/or high concentration of contaminants, etc. As a result, inhaling air in the structure may be extremely detrimental and may further result in death (e.g., within minutes). Furthermore, emergency work may often need to be performed from within the structure.

The emergency personnel's ability to alleviate the emergency in an efficient manner may be significantly limited by the lack of breathable air and/or abundance of contaminated air. A survival rate of stranded civilians in the structure may substantially decrease due to a propagation of contaminated air through out the structure, placing a large number of innocent lives at significant risk.

As such, the emergency personnel may utilize a portable breathable air apparatus (e.g., self-contained breathable air apparatus) as a source of breathable air during an emergency incident and/or a rescue mission. However, the portable breathable air apparatus may be heavy (e.g., 20-30 pounds) and/or may provide breathable air for a short while (e.g., approximately 15-30 minutes). In the emergency situation, the emergency personnel may need to walk, descend and/or climb to a particular location within the structure to perform rescuing work due to inoperable transport systems (e.g., obstructed walkway, elevators, moving sidewalks, and/or escalators, etc.)

As such, by the time the emergency personnel reach the particular location, his/her portable breathable air apparatus may be already depleted and may require replenishment (e.g., via a shuttle method or returning back to a previous location for a new portable breathable air apparatus). As a result, precious lives may be lost due to precious time being lost. An extra supply of portable breathable air apparatuses may be stored throughout the structure so that emergency personnel can replace their portable breathable air apparatuses within the structure. However, supplying structures with spare portable breathable air apparatuses may be expensive and take up space in the structure, thereby causing severe handicap to the ability of emergency personnel to perform rescue tasks.

Furthermore, management, supervisors, personnel, etc., may not regularly inspect the spare portable breathable air apparatuses. With time, the spare portable breathable air apparatuses may experience pressure loss placing the emergency personnel at significant risk when the spare breathable air apparatus is utilized in the emergency situation. The spare portable breathable air apparatuses may also be tampered with, during storage. Contaminants may be introduced into the spare portable breathable air apparatuses that may be detrimental to the emergency personnel.

SUMMARY

A breathable air safety system and method is disclosed. In an aspect, a safety system of a structure may include a supply unit (100) of a structure to facilitate delivery of breathable air from a source of compressed air to an air distribution system (150, 250, 350) of the structure, and a valve (408) to prevent leakage of the breathable air from the air distribution system (150, 250, 350) potentially leading to loss of system pressure. The safety system may further include a fill station (102A) interior to the structure to provide the breathable air to a breathable air apparatus at multiple locations of the structure, and a distribution structure (104) that is compatible with use with compressed air that facilitates dissemination of the breathable air of the source of compressed air to multiple locations of the structure.

The safety system may include an air storage sub-system (950) to provide an additional supply of air to the structure in addition to the source of compressed air, and an air storage tank (1008) of the air storage sub-system (950) to provide storage of air that is dispersible to the multiple locations of the structure. The safety system may include a secure chamber (612) of the fill station (102A) as a safety shield that confines a possible rupture of an over-pressurized breathable air apparatus within the secure chamber. The secure chamber (612) may be certified to be rupture containable according to approved standards.

The structure may include a building structure, a mine structure, and/or a tunnel structure. The safety system may include a plurality of air storage tanks (1008) of the air storage sub-system (950) that are coupled to each other through tubes (1000) having a looped configuration to increase robustness of the tubes (1000) through preventing breakage due to stress.

The safety system may include a booster tank (1006) of the air storage sub-system (950) coupled to the air storage tank (1008) to store compressed air of a higher pressure than the compressed air that is stored in the air storage tank (1008).

The safety system may include a driving air source (1002) of the air storage sub-system (950) to pneumatically drive a piston of a pressure booster (1004) to maintain a higher pressure of the air distribution system (150, 250, 350) such that a breathable air apparatus is reliably filled. The driving air source (1002) may enable the breathable air to be optimally supplied to the structure through allowing the breathable air to be isolated from driving the pressure booster (1004). The safety system may include an air monitoring system (110) to automatically track and record any of an impurity and a contaminant in the breathable air of the air distribution system (150, 250, 350). The air monitoring system (110) may include an automatic shut down feature to suspend air dissemination to the structure in case any impurity levels and contaminant levels exceed a safety threshold.

The safety system may include a pressure monitoring system to continuously track and record the system pressure of the air distribution system (150, 250, 350), and a pressure switch that is electrically coupled to an alarm system such that the alarm system is set off when the system pressure of the air distribution system (150, 250, 350) is outside a safety range. The pressure switch may electrically transmit a warning signal to an emergency supervising station when the system pressure of the air distribution system (150, 250, 350) is outside the safety range. The safety system may also include at least one indicator unit (614, 618) of the air storage sub-system (950) to provide status information of the air distribution system (150, 250, 350) including storage pressure, booster pressure, pressure of the source of compressed air, and the system pressure.

The safety system may include a supply unit enclosure (500) encompassing the supply unit (100) having one or more of a weather resistant feature, ultraviolet and infrared solar radiation resistant feature to prevent corrosion and physical damage. The safety system may also include a locking mechanism (502) of the supply unit enclosure (500) to secure the supply unit (100) from intrusions that potentially compromise safety and reliability of the air distribution system (150, 250, 350), and a a robust metallic material of the supply unit enclosure (500) to minimize a physical damage due to various hazards to protect the supply unit (100) from any of an intrusion and damage. The robust metallic material may be at least 18 gauge carbon steel. The safety system may further include at least one pressure gauge (400, 404) of the supply unit enclosure (500) to indicate any of the system pressure of the air distribution system and a fill pressure of the source of compressed air, and a tamper switch of the locking mechanism (502) of the supply unit enclosure (500) such that an alarm is automatically triggered and a signal is electrically coupled to any of relevant administrative personnel of the structure and an emergency supervising station when an intrusion of the supply unit (100) occurs.

The safety system may include a valve (408) of the supply unit (100) to automatically suspend transfer of breathable air from the source of compressed air to the air distribution system (150, 250, 350) when useful. The system may also include a selector valve (408) that is accessible by emergency personnel to selectively utilize the source of compressed air to deliver breathable air to the fill station (102A). The safety system may include one or more of a safety relief valve (408) of the supply unit (100) and the fill station (102A) to release the breathable air when a system pressure of the air distribution system (150, 250, 350) exceeds a threshold value beyond a design pressure to ensure reliability of the air distribution system (150, 250, 350) through maintaining the system pressure such that it is within a pressure rating of each component of the air distribution system (150, 250, 350).

The safety system may include one or more of a CGA connector (406) and a RIC/UAC connector (406) of the supply unit (100) to facilitate a connection with the source of compressed air through ensuring compatibility with the source of compressed air. The safety system may include an adjustable pressure regulator (602) of the supply unit (100) that is used to adjust a fill pressure of the source of compressed air to ensure that the fill pressure does not exceed design pressure of the air distribution system (150, 250, 350). The safety system may include a visible marking of the supply unit enclosure (500) and a fill station enclosure (624) to provide luminescence in a reduced light environment.

The safety system may include another valve (408) of the fill station (102A) to prevent leakage of air from the air distribution system (150, 250, 350) potentially leading to a pressure loss of the air distribution system (150, 250, 350) through ensuring that the system pressure is maintained within a threshold range of a design pressure to reliably fill the breathable air apparatus. The safety system may also include at least one pressure regulator (402) of each of the fill station (102A) to adjust a fill pressure to fill the breathable air apparatus and to ensure that the fill pressure does not exceed a pressure rating of the breathable air apparatus potentially resulting in a rupture of the breathable air apparatus.

The safety system may include an isolation valve (408) of the fill station (102A) to isolate the fill station (102A) from a remaining portion of the air distribution system (150, 250, 350). The isolation valve (408) may be automatically actuated based on an air pressure sensor (108) of the air distribution system (150, 250, 350). The safety system may include at least one pressure gauge (400, 404) of the fill station (102A) to indicate any of a fill pressure of the fill station (102A) and a system pressure of the air distribution system (150, 250, 350). The safety system may include at least one of a fire rated material (702) and a fire rated assembly to enclose the distribution structure (104) such that the distribution structure (104) has an ability to withstand elevated temperatures for a prescribed period of time. The safety system may also include a sleeve that is at least three times an outer diameter of each of a plurality of pipes of the distribution structure (104) exterior to the fire rated material (702) to further protect the fire rated material (702) from any damage. Both ends of the sleeve may be fitted with the fire rated material (702) that is approved by an authority agency (604).

The safety system may include a robust solid casing of the distribution structure (104) to prevent physical damage to the distribution structure (104) potentially compromising a safety and integrity of the air distribution system (150, 250, 350). The safety system may further include another sleeve at least three times an outer diameter of a pipe of the distribution structure (104) exterior to the robust solid casing to further protect the robust solid casing from any damage. Both ends of another sleeve may be fitted with a fire rated material (702) that is approved by an authority agency (604). The safety system may also include a plurality of support structures of each pipe of the distribution structure (104) at intervals no larger than five feet to provide adequate structural support for each pipe, wherein the distribution structure (104) comprises any of a stainless steel and a thermoplastic material that is compatible for use with compressed air.

The safety system may include an air monitoring system (110) to automatically track and record any of an impurity and a contaminant in the breathable air of the air distribution system (150, 250, 350). The air monitoring system (110) may include an automatic shut down feature to suspend air distribution to the fill station (102A) in a case that any of an impurity level and a contaminant concentration exceeds a safety threshold, and a pressure monitoring system (108) to automatically track and record the system pressure of the air distribution system (150, 250, 350). The air monitoring system may also include a pressure switch that is electrically coupled to a fire alarm system of the structure such that the fire alarm system is set off when the system pressure of the air distribution system (150, 250, 350) is outside a safety range. The pressure switch may electrically transmit a warning signal to an emergency supervising station when the system pressure of the air distribution system (150, 250, 350) is outside the safety range.

The fill station (102A) may have a physical capacity to enclose at least one breathable air apparatus and includes a RIC/UAC connector (406, 610) that expedites a filling process of the breathable air apparatus. The air storage subsystem (950) may be housed in a fire rated enclosure (624) that is certified to be rupture containable to withstand elevated temperatures for a prescribed amount of time. The safety system may include a securing mechanism of the secure chamber (612) of the fill station (102A) that includes a locking function that is automatically actuated via a coupling mechanism with a flow switch that indicates a status of air flow to the breathable air apparatus that is fillable in the fill station (102A).

The building structure may include a first set of walls extending vertically and horizontally enclosing an area of land such that the area of land is in an internal region of the building structure, and a second set of walls that divide the internal region of the building structure in any of a horizontal and vertical direction into rooms displaced any of horizontally and vertically from one another. The supply unit (100) may be adjacent to a particular wall of the first set of walls to facilitate delivery of breathable air from a source of compressed air to an emergency support system of the building structure.

BRIEF DESCRIPTION OF THE DRAWINGS

Example embodiments are illustrated by way of example and not limitation in the figures of the accompanying drawings, in which like references indicate similar elements and in which:

FIG. 4A is a front view of a supply unit, according to one embodiment.

FIG. 4B is a rear view of a supply unit, according to one embodiment.

Figure 1:
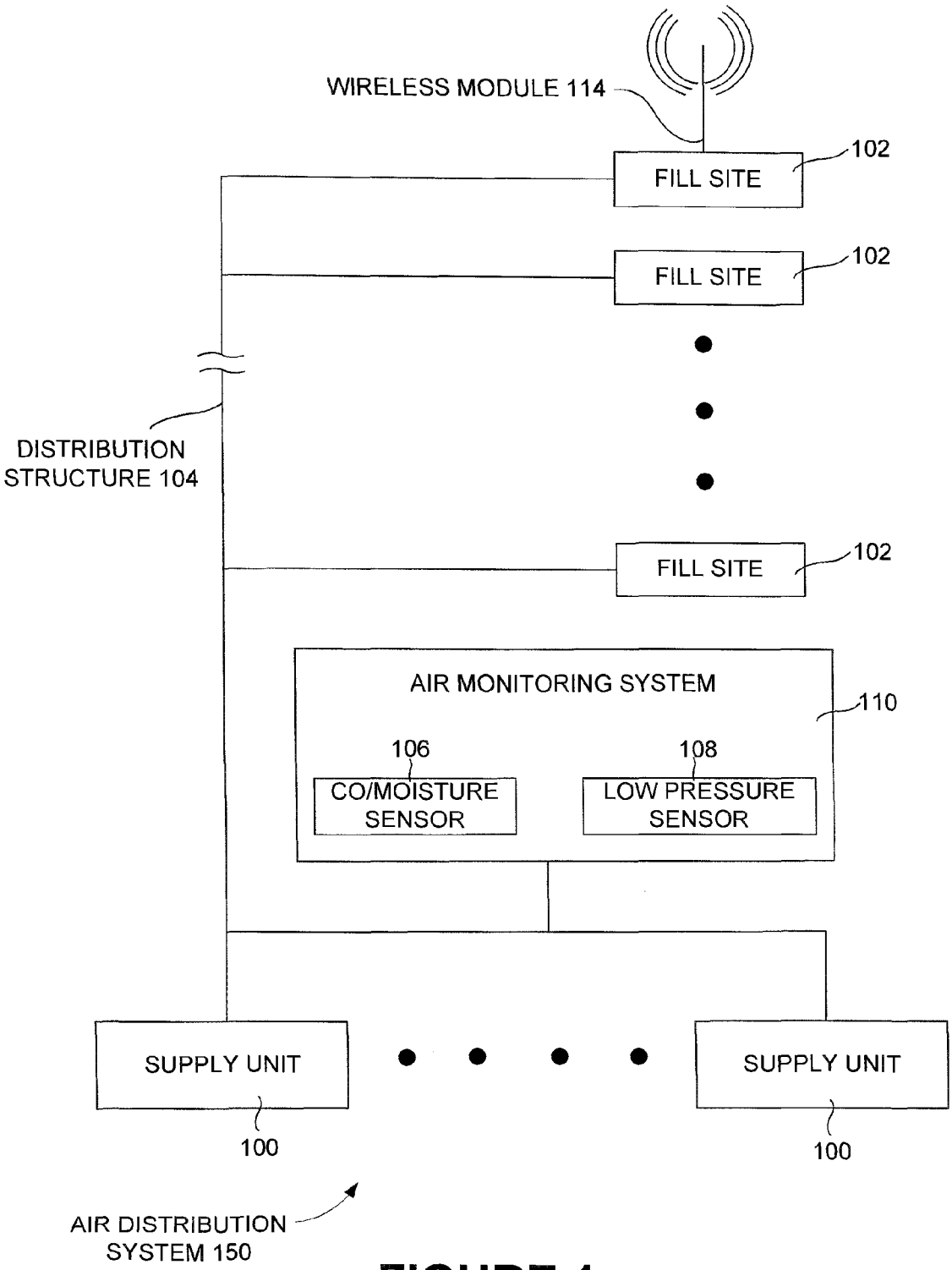
FIG. 1 is a diagram of an air distribution system in a structure, according to one embodiment.

Other features of the present embodiments will be apparent from the accompanying drawings and from the detailed description that follows.

DETAILED DESCRIPTION

A breathable air safety system and method is disclosed. In the following description, for purposes of explanation, numerous specific details are set forth in order to provide a thorough understanding of the various embodiments. It will be evident, however to one skilled in the art that the various embodiments may be practiced without these specific details.

In one embodiment, a safety system of a structure includes a supply unit (e.g., a supply unit 100 of FIGS. 1-3) of a structure to facilitate delivery of breathable air from a source of compressed air to an air distribution system (e.g., an air distribution system 150, 250, 350 of FIGS. 1-3) of the structure, a valve (e.g., a valve of a series of valves 410 of FIG. 4) to prevent a leakage of the breathable air from the air distribution system (e.g., the air distribution system 150, 250, 350 of FIGS. 1-3) potentially leading to loss of a system pressure, a fill site (e.g., a fill site 102B of FIG. 6B, and/or a fill station 102A of FIG. 6A) interior to the structure to provide the breathable air to a breathable air apparatus at multiple locations of the structure, a secure chamber housing the fill site (e.g., the fill site 102B of FIG. 6B, and/or the fill station 102A of FIG. 6A) as a safety shield that confines a possible rupture of an over-pressurized breathable air apparatus within the secure chamber, a distribution structure (e.g., a distribution structure 104 of FIGS. 1-3) that is compatible with use with compressed air that facilitates dissemination of the breathable air of the source of compressed air to multiple locations of the structure, and/or an air storage sub-system (e.g., an air storage sub-system 1050 of FIG. 9) to provide an additional supply of air in addition to the source of compressed air.

In another embodiment, a method may include ensuring that a prescribed pressure of the emergency support system (e.g., the air distribution system 150, 250, 350 of FIGS. 1-3) maintains within a threshold range of the prescribed pressure by including a valve of a supply unit (e.g., the supply unit 100 of FIGS. 1-3) to prevent leakage of breathable air from the emergency support system (e.g., the air distribution system 150, 250, 350 of FIGS. 1-3), safeguarding a filling process of a breathable air apparatus by enclosing the breathable air apparatus in a secure chamber of a fill site (e.g., a fill site 102B of FIG. 6B, and/or a fill station 102A of FIG. 6A) to provide a safe placement to supply the breathable air to the breathable air apparatus, and/or providing a spare storage of breathable air through an air storage tank of a storage sub-system to store breathable air that is replenishable with a source of compressed air.

In yet another embodiment, a building structure (e.g., a horizontal building structure such as a shopping mall, IKEA®, The Home Depot®, a vertical building structure such as a high rise building, a mid rise building, and/or a low rise building, a mine, a subway, and/or a tunnel, etc.) may include a first set of walls extending vertically and horizontally enclosing an area of land such that the area of land is in the internal region of the building structure, a second set of isolating walls that divide the internal region of the building structure in any of a horizontal and vertical direction into rooms displaced any of a horizontally and vertically from one another, a supply unit (e.g., the supply unit 100 of FIGS. 1-3) adjacent to a particular wall of the first set of walls to facilitate delivery of breathable air from a source of compressed air to an emergency support system (e.g., the air distribution system 150, 250, 350 of FIGS. 1-3) of the building structure, a fill site (e.g., the fill site 102B of FIG. 6B, and/or the fill station 102A of FIG. 6A) of the internal region of the building structure to provide the breathable air to a breathable air apparatus at multiple locations of the building structure, a secure chamber of the fill site (e.g., the fill site 102B of FIG. 6B, and/or the fill station 102A of FIG. 6A) as a safety shield that confine a possible rupture of an over-pressurized breathable air apparatus within the secure chamber, a distribution structure (e.g., a distribution structure 104 of FIGS. 1-3) that is compatible with use with compressed air that facilitates dissemination of the breathable air of the source of compressed air to multiple locations of the building structure, and/or an air storage sub-system (e.g., the air storage sub-system 1050 of FIG. 9) to provide an additional supply of air to the building structure in addition to the source of compressed air.

FIG. 1 is a diagram of an air distribution system 150 in a structure, according to one embodiment. The air distribution system 150 may include any number of supply units 100, any number of fill sites 102 (e.g., a fill panel and/or a fill station, etc.) that are coupled to the rest of the air distribution system 150 through a distribution structure 104. The air distribution system 150 may also include an air monitoring system 110 having a CO/Moisture sensor 106 and a pressure sensor 108. The supply unit 100 may be placed at a number of locations exterior to the building structure (e.g., a horizontal building structure such as a shopping mall, IKEA®, The Home Depot®, a vertical building structure such as a high rise building, a mid rise building, and/or a low rise building, a mine, a subway, and/or a tunnel, etc.) to allow ease of access by a source of compressed air and/or to expedite supplying the air distribution system 150 with breathable air. The supply units 100 may also be placed at locations that are substantially free of traffic (e.g., parked cars, vehicle movement, and/or human traffic, etc.) to decrease potential obstruction that may be present in an emergency situation (e.g., a building fire, a chemical attack, terror attack, subway accident, mine collapse, and/or a biological agent attack, etc.).

The fill site 102 may also be placed at a number of locations of the building structure (e.g., a horizontal building structure such as a shopping mall, IKEA®, The Home Depot®, a vertical building structure such as a high rise building, a mid rise building, and/or a low rise building, a mine, a subway, and/or a tunnel, etc.) to provide multiple access points to breathable air in the building structure. The building structure may have any number of fill sites 102 (e.g., a fill panel and/or a fill station, etc.) on each floor and/or have fill sites 102 (e.g., a fill panel and/or a fill station, etc.) on different floors. Each fill site 102 may be sequentially coupled to one another and to the supply units 100 through the distribution structure 104. The distribution structure 104 may include any number of pipes to expand an air carrying capacity of the air distribution system 150 such that breathable air may be replenished at a higher rate. In addition, the fill site 102 may include wireless capabilities (e.g., a wireless module 114) for communication with remote entities (e.g., the supply unit 100, building administration, and/or an authority agency, etc.).

The air monitoring system 110 may contain multiple sensors such as the CO/moisture sensor 106 and the pressure sensor 108 to track air quality of the breathable air in the air distribution system 150. Since emergency personnel (e.g., a fire fighter, a SWAT team, a law enforcer, and/or a medical worker, etc.) depend on the breathable air distributed via the air distribution system 150, it is crucial that air quality of the breathable air be constantly maintained. The air monitoring system 110 may also include other sensors that detect other hazardous substances (e.g., benzene, acetamide, acrylic acid, asbestos, mercury, phosphorous, propylene oxide, etc.) that may contaminate the breathable air.

In one embodiment, the distribution structure 104 may be compatible with use with compressed air facilitates dissemination of the breathable air of the source of compressed air to multiple locations of the building structure. A fire rated material may encase the distribution structure 104 such that the distribution structure has the ability to withstand elevated temperatures for a period of time. The pipes of the distribution structure 104 may include a sleeve exterior to the fire rated material to further protect the fire rated material from any damage. Both ends of the sleeve may be fitted with a fire rated material that is approved by an authority agency. In addition, the distribution structure 104 may include a robust solid casing to prevent physical damage to the distribution structure potentially compromising the safety and integrity of the air distribution system.

The distribution structure 104 may include support structures at intervals no larger than five feet to provide adequate structural support for each pipe of the distribution structure 104. The pipes and the fittings of the distribution structure 104 may include any of a stainless steel and a thermoplastic material that is compatible for use with compressed air.

In another embodiment, the air distribution system may include an air monitoring system (e.g., the air monitoring system 110) to automatically track and record any impurities and contaminants in the breathable air of the air distribution system. The air monitoring system (e.g., the air monitoring system 110) may have an automatic shut down feature to suspend air distribution to the fill sites 102 in a case that any of an impurity and contaminant concentration exceeds a safety threshold. For example, a pressure monitoring system (e.g., the pressure sensor 108) may automatically track and record the system pressure of the air distribution system. Further, a pressure switch may be electrically coupled to a alarm system such that the fire alarm system is set off when the system pressure of the air distribution system is outside a safety range.

Figure 2:
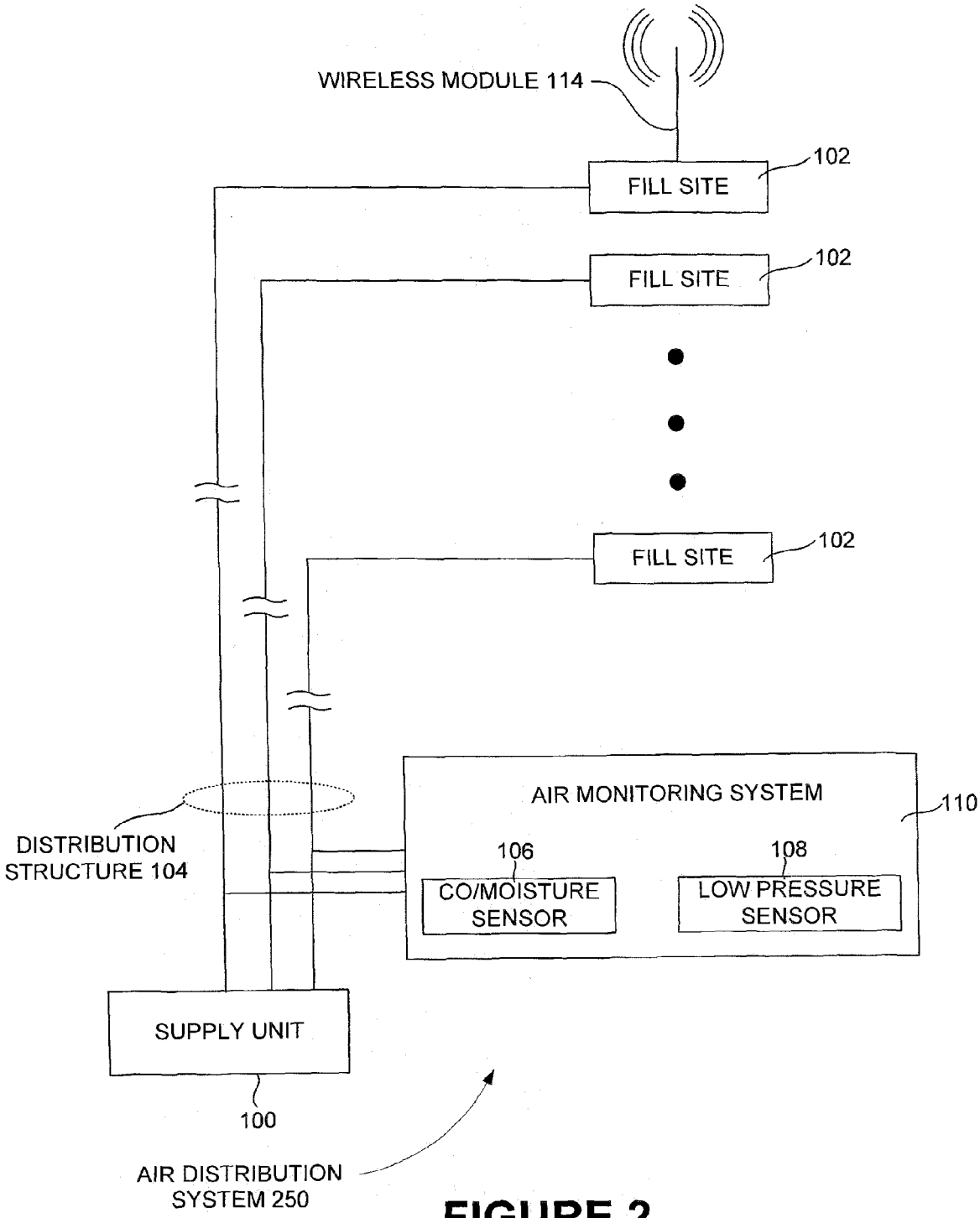
FIG. 2 is another diagram of an air distribution system in a structure, according to one embodiment.

FIG. 2 is another diagram of an air distribution system 250 in a structure, according to one embodiment. The air distribution system 250 may include any number of supply units 100, any number of fill sites 102 (e.g., a fill panel and/or a fill station, etc.) that are coupled to the rest of the air distribution system 150 through a distribution structure 104. The air distribution system 150 may also include an air monitoring system 110 having a CO/Moisture sensor 106 and a pressure sensor 108. In the air distribution system 250, the distribution structure 104 may individually couple each fill site 102 (e.g., a fill panel and/or a fill station, etc.) to a supply unit 100. Individual coupling may be advantageous in that in the case one pipe of the distribution structure 104 becomes inoperable the other pipes can still deliver air to the fill sites 102 (e.g., a fill panel and/or a fill station, etc.). The other system components (e.g., the fill site 102, the supply unit 100, and the air monitoring system 110 were described in detail in the previous section).

Figure 3:
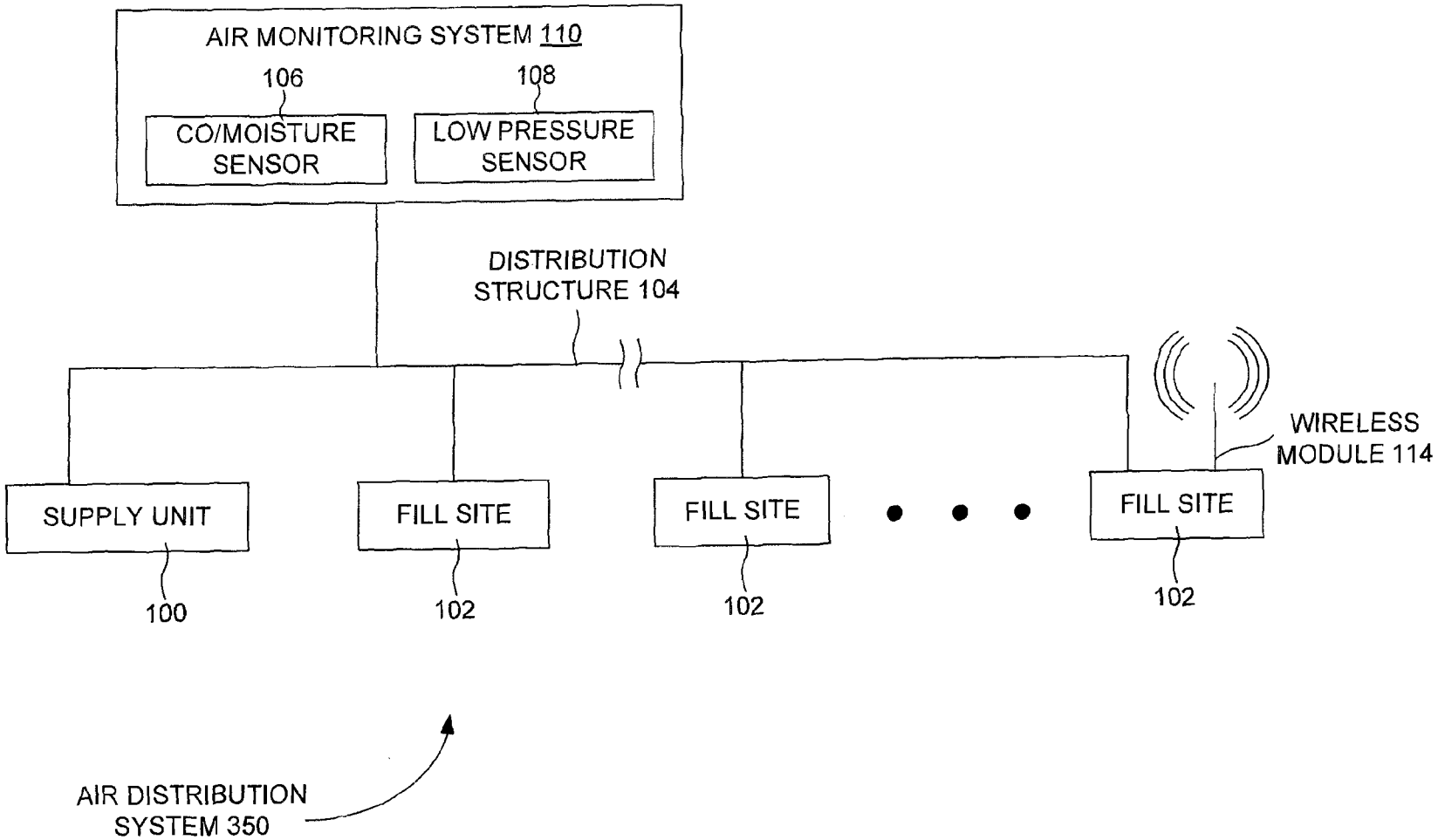
FIG. 3 is a diagram of an air distribution system in a structure having fill sites located horizontally from one another, according to one embodiment.

FIG. 3 is a diagram of an air distribution system 350 in a structure having fill sites 102 (e.g., a fill panel and/or a fill station, etc.) located horizontally from one another, according to one embodiment.

The air distribution system 350 may include any number of supply units 100, any number of fill sites 102 (e.g., a fill panel and/or a fill station, etc.) that are coupled to the rest of the air distribution system 150 through a distribution structure 104. The air distribution system 150 may also include an air monitoring system 110 having a CO/Moisture sensor 106 and a pressure sensor 108. In the air distribution system 250, the distribution structure 104 may sequentially couple each fill site 102 (e.g., a fill panel and/or a fill station, etc.) displaced predominantly horizontally from a supply unit 100. Each air distribution system (e.g., the air distribution system 150, 250, 350) may be used in conjunction with one another depending on the particular architectural style of the building structure in a manner that provides most efficient access to the breathable air of the air distribution system reliably. The other system components (e.g., the fill site 102, the supply unit 100, and the air monitoring system 110 were described in detail in the previous section).

FIG. 4A is a front view of a supply unit 100, according to one embodiment. The supply unit 100 provides accessibility of a source of compressed air to supply air to an air distribution system (e.g., an air distribution system 150, 250, and/or 350). The supply unit may include a fill pressure indicator 400, a fill control knob 402, a system pressure indicator 404, and/or a connector 406. The fill pressure indicator 400 may indicate the pressure level at which breathable air is being delivered by the source of compressed air to the air distribution system (e.g., an air distribution system 150, 250, and/or 350 of FIGS. 1-3). The system pressure indicator 404 may indicate the current pressure level of the breathable air in the air distribution system. The fill control knob 402 may be used to control the fill pressure such that the fill pressure does not exceed a safety threshold that the air distribution system is designed for. The connector 406 may be a CGA connector that is compatible with an air outlet of the source of compressed air of various emergency agencies (e.g., fire station, law enforcement agency, medical provider, and/or SWAT team, etc.). The connector 406 (e.g., CGA connector) of the supply unit 100 may facilitate a connection with the source of compressed air through ensuring compatibility of the supply unit 100 with the source of compressed air.

The supply unit 100 may include an adjustable pressure regulator of the supply unit 100 that is used to adjust a fill pressure of the source of compressed air to ensure that the fill pressure does not exceed the design pressure of the air distribution system. Further, the supply unit may also include at least one pressure gauge of the supply unit enclosure to indicate any of the system pressure (e.g., the system pressure indicator 404) of the air distribution system and the fill pressure (e.g., the fill pressure indicator 400) of the source of compressed air.

FIG. 4B is a rear view of a supply unit 100, according to one embodiment. The supply unit also includes a series of valves 410 (e.g., a valve, an isolation valve, and/or a safety relief valve, etc.) to further ensure that system pressure is maintained within a safety threshold of the design pressure of the air distribution system.

The supply unit 100 of a building structure may facilitate delivery of breathable air from a source of compressed air to an air distribution system of the building structure. The supply unit 100 includes the series of valves 410 (e.g., the valve, and/or the safety relief valve, etc.) to prevent a leakage of the breathable air from the air distribution system potentially leading to loss of a system pressure. For example, the supply unit 100 may include the valve of the series of valves 410 to automatically suspend transfer of breathable air from the source of compressed air to the air distribution system when useful. The safety relief valve of the supply unit 100 and/or the fill site 102 may release breathable air when a system pressure of the air distribution system exceeds a threshold value beyond the design pressure to ensure reliability of the air distribution system through maintaining the system pressure such that it is within a pressure rating of each component of the air distribution system.

Figure 5:
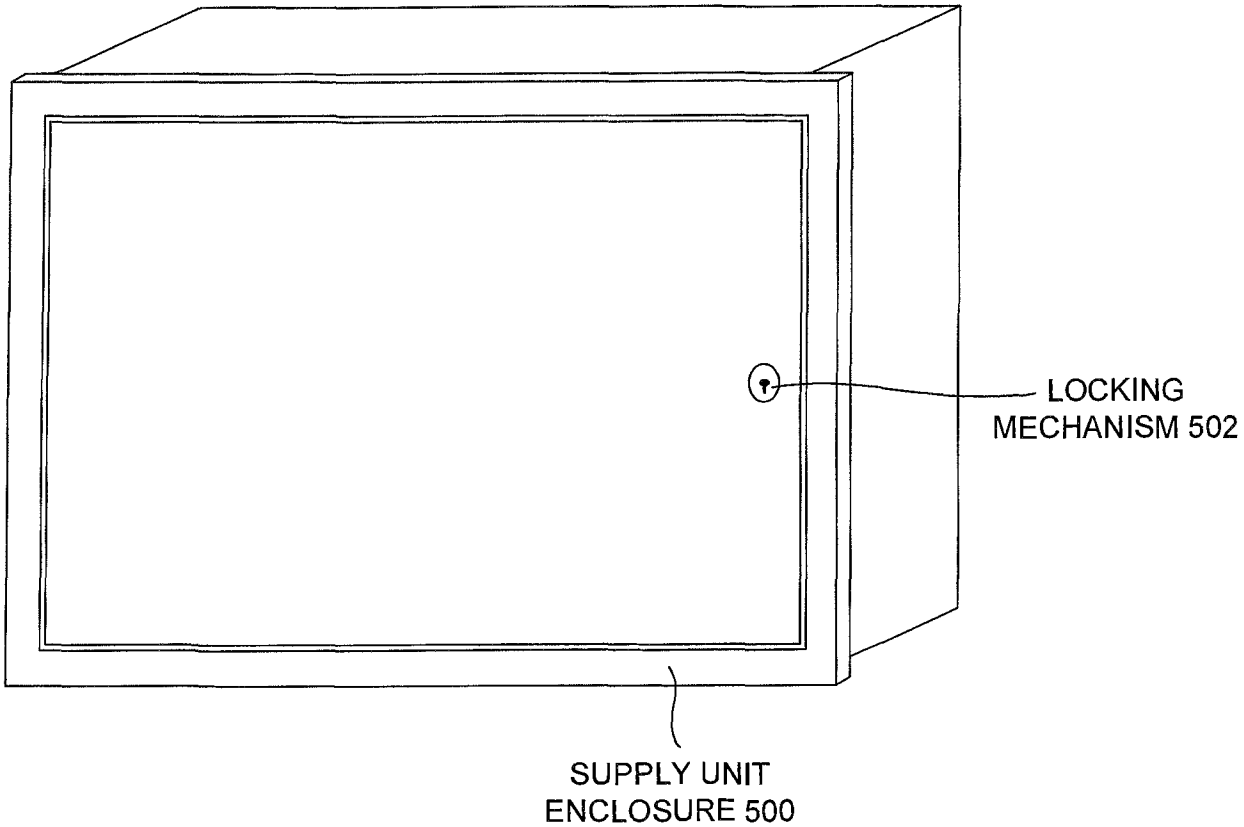
FIG. 5 is an illustration of a supply unit enclosure, according to one embodiment.

FIG. 5 is an illustration of a supply unit enclosure 500, according to one embodiment. The supply unit enclosure 500 may include a locking mechanism 502 to secure the supply unit 100 from unauthorized access. Further, the supply unit enclosure 500 may also contain fire rated material such that the supply unit 100 is able to withstand burning elevated temperatures.

The supply unit enclosure 500 encompassing the supply unit 100 may have any of a weather resistant feature, ultraviolet and infrared solar radiation resistant feature to prevent corrosion and physical damage. The locking mechanism 502 may secure the supply unit from intrusions that potentially compromise safety and reliability of the air distribution system. In addition, the supply unit enclosure 500 may include a robust metallic material of the supply unit enclosure 500 to minimize a physical damage due to various hazards to protect the supply unit 100 from any of an intrusion and damage. The robust metallic material may be at least substantially 18 gauge carbon steel. The supply unit enclosure 500 may include a visible marking to provide luminescence in a reduced light environment. The locking mechanism 502 may also include a tamper switch such that a alarm is automatically triggered and a signal is electrically coupled to any of a relevant administrative personnel of the building structure and the emergency supervising station when an intrusion of any of the supply unit and the secure chamber occurs.

Figure 6A:
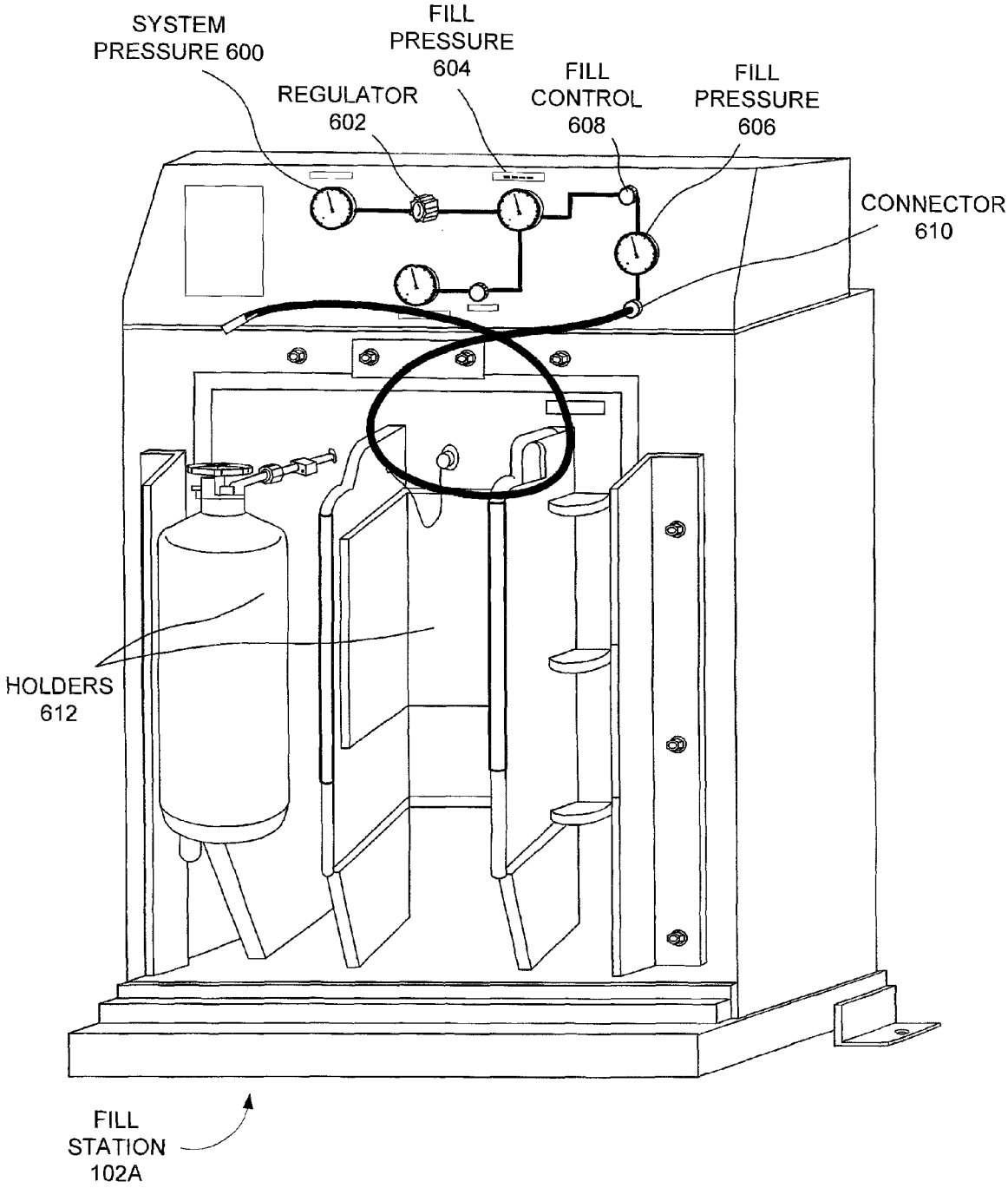
FIG. 6A is an illustration of a fill station, according to one embodiment.

FIG. 6A is an illustration of a fill station 102A, according to one embodiment. The fill station 102A may be a type of fill site 102 of FIG. 1. The fill station 102A may include a system pressure indicator 600, a regulator 602, a fill pressure indicator 604, another fill pressure indicator 606, and/or fill control knob 608. The fill station 102A may also include a RIC/UAC connector 610 and multiple breathable air apparatus holders 612 used to supply air from the air distribution system. The fill pressure indicator 604 may indicate the pressure level at which breathable air is being delivered by the source of compressed air to the air distribution system (e.g., an air distribution system 150, 250, and/or 350 of FIGS. 1-3). The system pressure indicator 600 may indicate the current pressure level of the breathable air in the air distribution system. The fill control knob 608 may be used to control the fill pressure such that the fill pressure does not exceed a safety threshold that the air distribution system is designed for. The RIC/UAC connector 610 may facilitate direct coupling to emergency equipment to supply breathable air through a hose that is connected to the RIC/UAC connector 610. In essence, precious time may be saved because the emergency personnel may not need to spend the time to remove the emergency equipment from their rescue attire before they can be supplied with breathable air. Further, the RIC/UAC connector 610 may also directly couple to a face-piece of a respirator to supply breathable air.

The multiple breathable air apparatus holders 612 can hold multiple compressed air cylinders to be filled simultaneously. In addition, the multiple breathable air apparatus holders 612 can be rotated such that additional compressed air cylinders may be loaded while the multiple compressed air cylinders are filled inside the fill station 102A. The fill station 102A may be a rupture containment chamber such that over-pressurized compressed air cylinders are shielded and contained to prevent injuries.

In one embodiment, the fill station 102A interior to the building structure may provide the breathable air to a breathable air apparatus at multiple locations of the building structure. A secure chamber of the fill station 102A may be a safety shield that confines a possible rupture of an over-pressurized breathable air apparatus within the secure chamber. The fill station 102A may include a valve to prevent leakage of air from the air distribution system potentially leading to pressure loss of the air distribution system through ensuring that the system pressure is maintained within a threshold range of the design pressure to reliably fill the breathable air apparatus. An isolation valve may be included to isolate a breathable fill station from a remaining portion of the air distribution system.

The isolation valve may be automatically actuated based on an air pressure sensor of the air distribution system. The fill station 102A may include at least one pressure regulator to adjust a fill pressure to fill the breathable air apparatus and to ensure that the fill pressure does not exceed the pressure rating of the breathable air apparatus potentially resulting in a rupture of the breathable air apparatus. The fill station 102A may include at least one pressure gauge to indicate any of a fill pressure (e.g., the fill pressure indicator 604, 606) of the fill station and a system pressure (e.g., the system pressure indicator 600) of the air distribution system. In one embodiment, the fill station 102A may have a physical capacity to enclose at least one breathable air apparatus and may include a RIC/UAC connector to facilitate a filling of the breathable air apparatus. The fill station may also include a securing mechanism of the secure chamber of the fill station having a locking function is automatically actuated via a coupling mechanism with a flow switch that indicates a status of air flow to the breathable air apparatus that is fillable in the fill station.

Figure 6B:
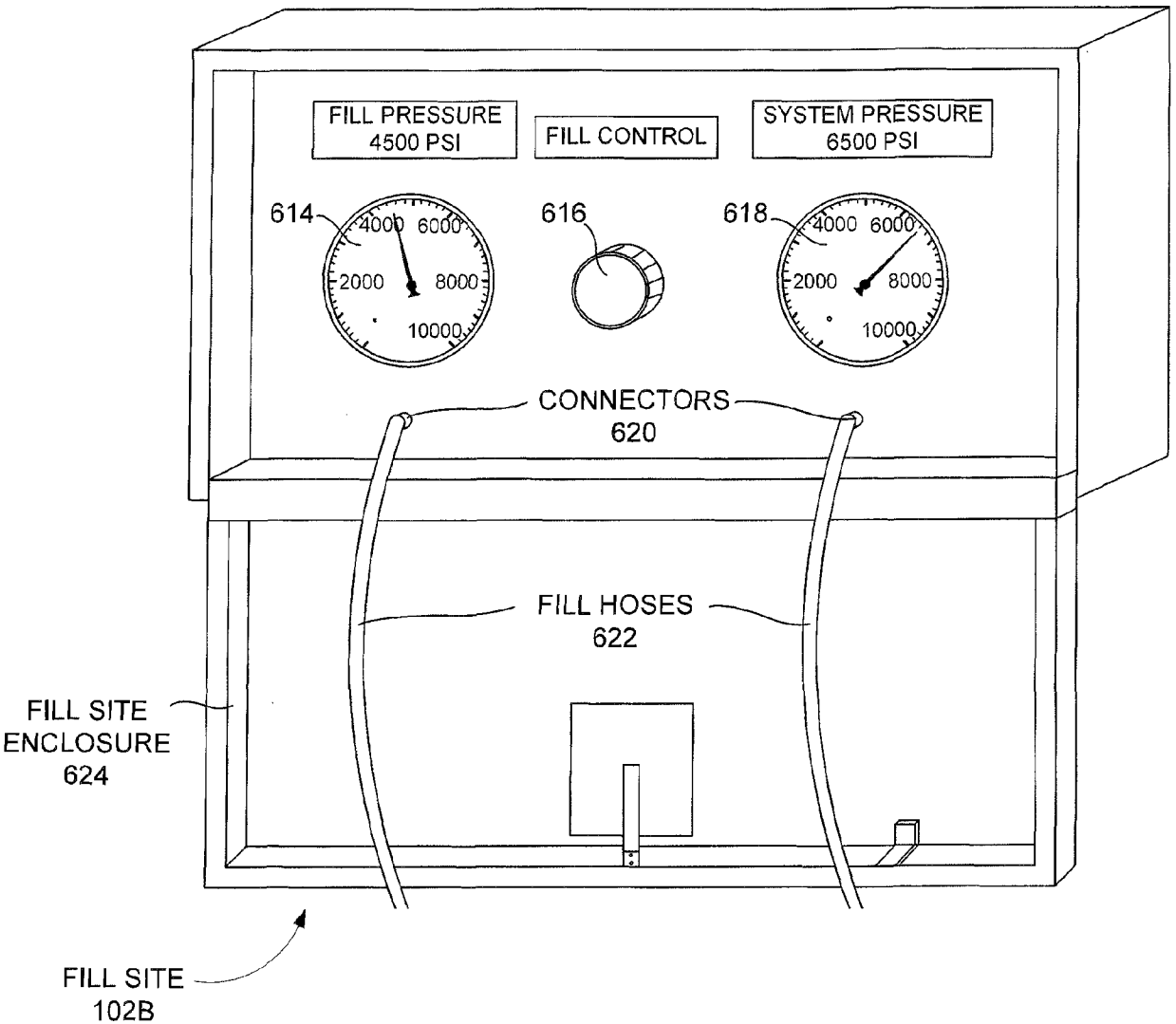
FIG. 6B is an illustration of a fill site, according to one embodiment.

FIG. 6B is an illustration of a fill site 102B, according to one embodiment. The fill site 102B (e.g., fill panel) includes a fill pressure indicator 614 (e.g., pressure gauge), a fill control knob 616 (e.g., pressure regulator), a system pressure indicator 618, a number of connector 620 (e.g., RIC/UAC connector), and/or fill hoses 622. The fill site 102B may also include a locking mechanism of a fill site enclosure 624 (e.g., a fill panel enclosure) to secure the fill panel from intrusions that potentially compromise safety and reliability of the air distribution system. The system pressure indicator 618 may indicate the current pressure level of the breathable air in the air distribution system. The fill control knob 616 (e.g., pressure regulator) may be used to adjust the fill pressure such that the fill pressure does not exceed a safety threshold that the air distribution system is designed for.

The connector 620 may facilitate direct coupling to emergency equipment to supply breathable air through a hose that is connected to the connector 620. In essence, precious time may be saved because the emergency personnel may not need to spend the time to remove the emergency equipment from their rescue attire before they can be supplied with breathable air. Further, the connector 620 connected with the fill hoses 622 may also directly couple to a face-piece of a respirator to supply breathable air to either emergency personnel (e.g., a fire fighter, a SWAT team, a law enforcer, and/or a medical worker, etc.) and/or stranded survivors in need of breathing assistance. Each of the fill hoses 622 may have different pressure rating of the fill site 102B is couple-able to any of a self-contained breathable air apparatus and respiratory mask having a compatible RIC/UAC connector. The fill panel enclosure may include a visible marking to provide luminescence in a reduced light environment.

The fill site 102B interior to the building structure may have the connector 620 (e.g., the RIC/UAC connector) to fill a breathable air apparatus to expedite a breathable air extraction process from the air distribution system and to provide the breathable air to the breathable air apparatus at multiple locations of the building structure. The fill site 102B may include a safety relief valve set to have an open pressure of at most approximately 10% more than a design pressure of the air distribution system to ensure reliability of the air distribution system through maintaining the system pressure such that it is within a threshold range of a pressure rating of each component of the air distribution system. The fill site enclosure 624 may comprise of at least 18 gauge carbon steel to minimize physical damage of various naturally occurring and man-imposed hazards through protecting the fill panel from any of an intrusion and damage. The fill site 102B may include an isolation valve to isolate a damaged fill panel from a remaining operable portion of the air distribution system.

Figure 7B:
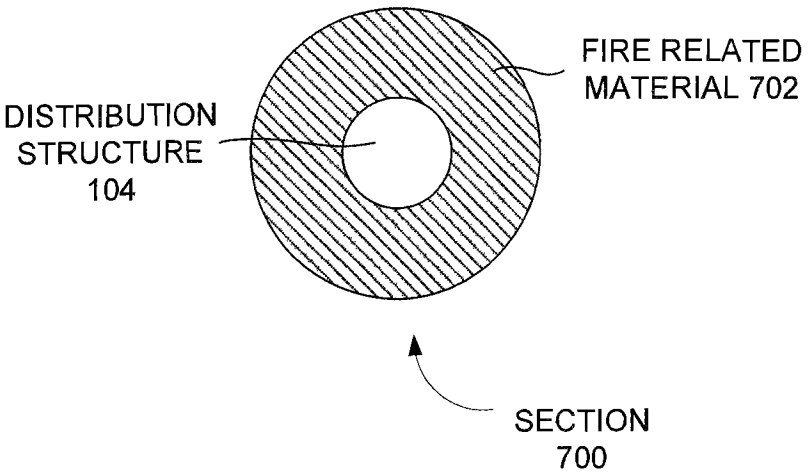
FIG. 7B is a cross sectional view of a distribution structure embedded in a fire Rated material, according to one embodiment.
Figure 7A:
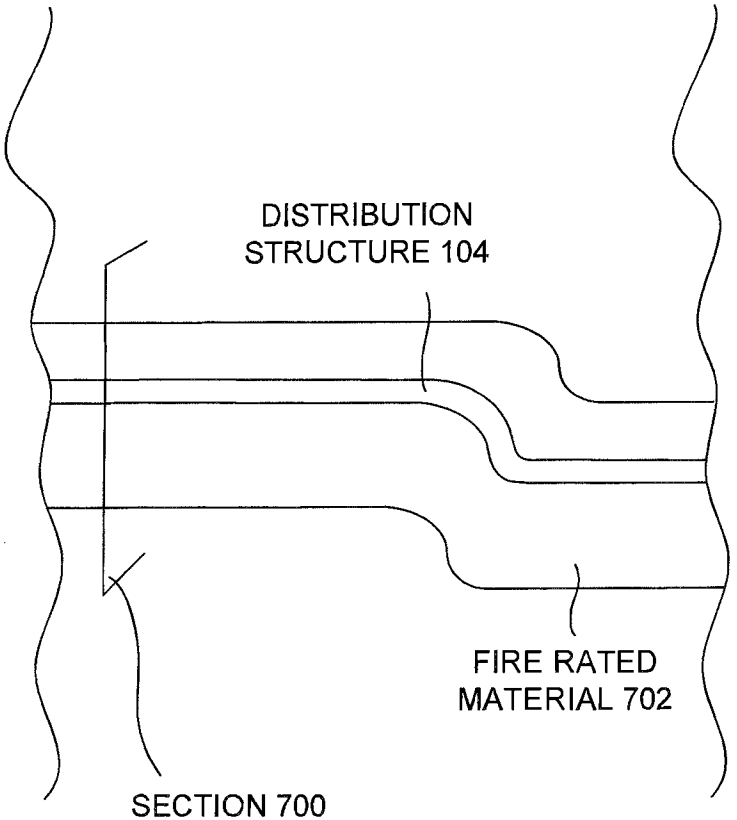
FIG. 7A is a diagrammatic view of a distribution structure embedded in a fire rated material, according to one embodiment.

FIG. 7A is a diagrammatic view of a distribution structure 104 embedded in a fire rated material, according to one embodiment. The distribution structure 104 may be enclosed in the fire rated material 702. The fire rated material may prevent the distribution structure 104 from damage in a fire such that an air distribution system (e.g., the air distribution system 150, 250, 350 of FIGS. 1-3) may be operational for a longer time period in an emergency situation (e.g., a building fire, a chemical attack, terror attack, subway accident, mine collapse, and/or a biological agent attack, etc.). Section 700 is a cross section of the distribution structure 104 embedded in the fire rated material 702.

FIG. 7B is a cross sectional view 700 of a distribution structure embedded in a fire rated material, according to one embodiment. Section 700 is a cross section of the distribution structure 104 embedded in the fire rated material 702.

Figure 8:
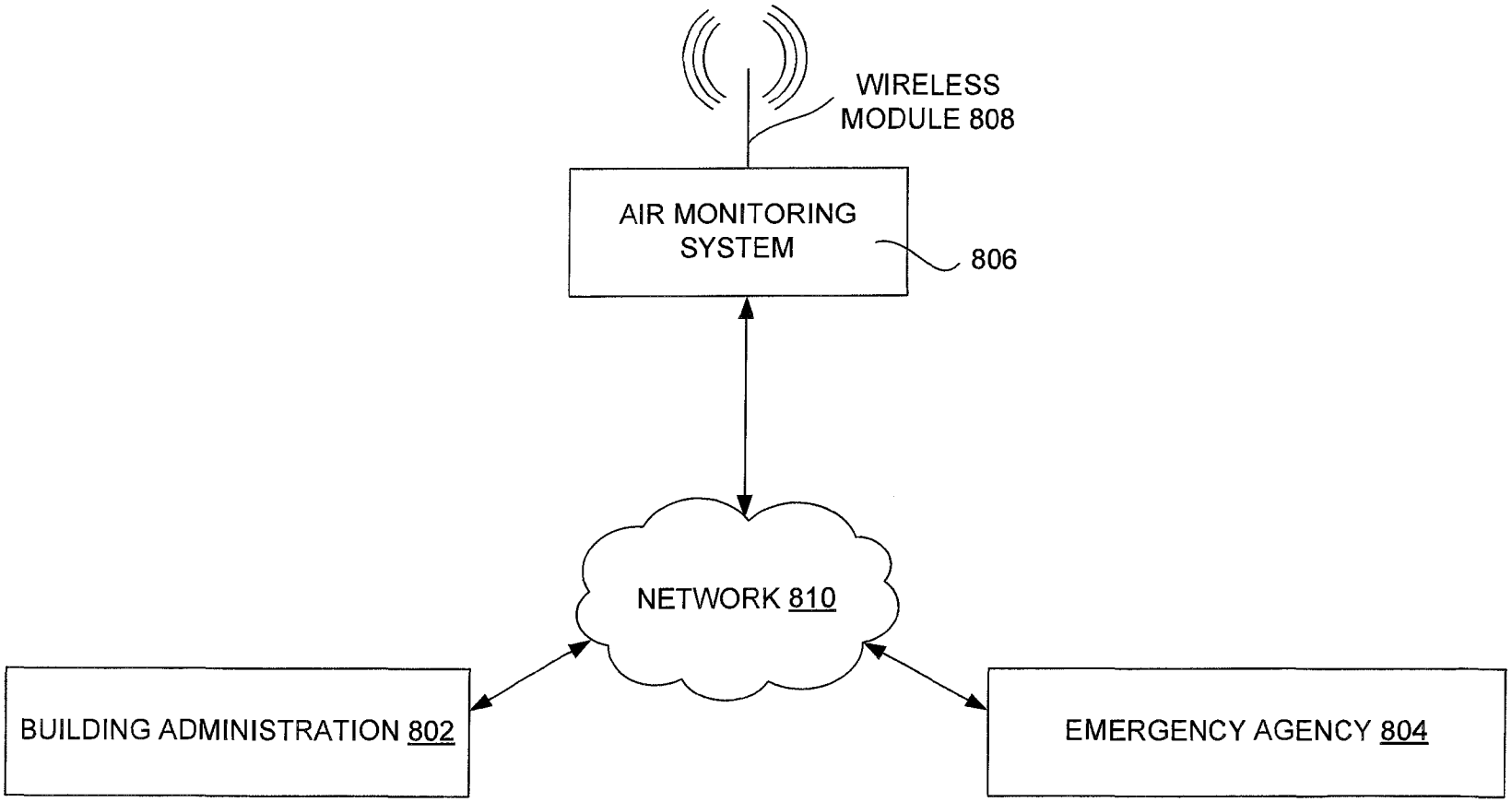
FIG. 8 is a network view of an air monitoring system that communicates with a building administration and an authority agency, according to one embodiment.

FIG. 8 is a network view of an air monitoring system 806 with a wireless module 808 that communicates with a building administration 802 and an authority agency 804 through a network 810, according to one embodiment. The air monitoring system 806 may include various sensors (e.g., CO/moisture sensor 106 of FIG. 1, pressure sensor 108 of FIG. 1, and/or hazardous substance sensor, etc.) and/or status indicators regarding system readiness information (e.g., system pressure, in use, not in use, operational status, fill site usage status, fill site operational status, etc.). The air monitoring system 806 may communicate sensor readings to a building administration 802 (e.g., building management, security, and/or custodial services, etc.) such that proper maintenance measures may be taken. The air monitoring system 806 may also send alerting signals as a reminder for regular system inspection and maintenance to the building administration 802 through the network 810. The air monitoring system 806 may also communicate sensor readings to an authority agency 804 (e.g., a police station, a fire station, and/or a hospital, etc.).

Figure 9:
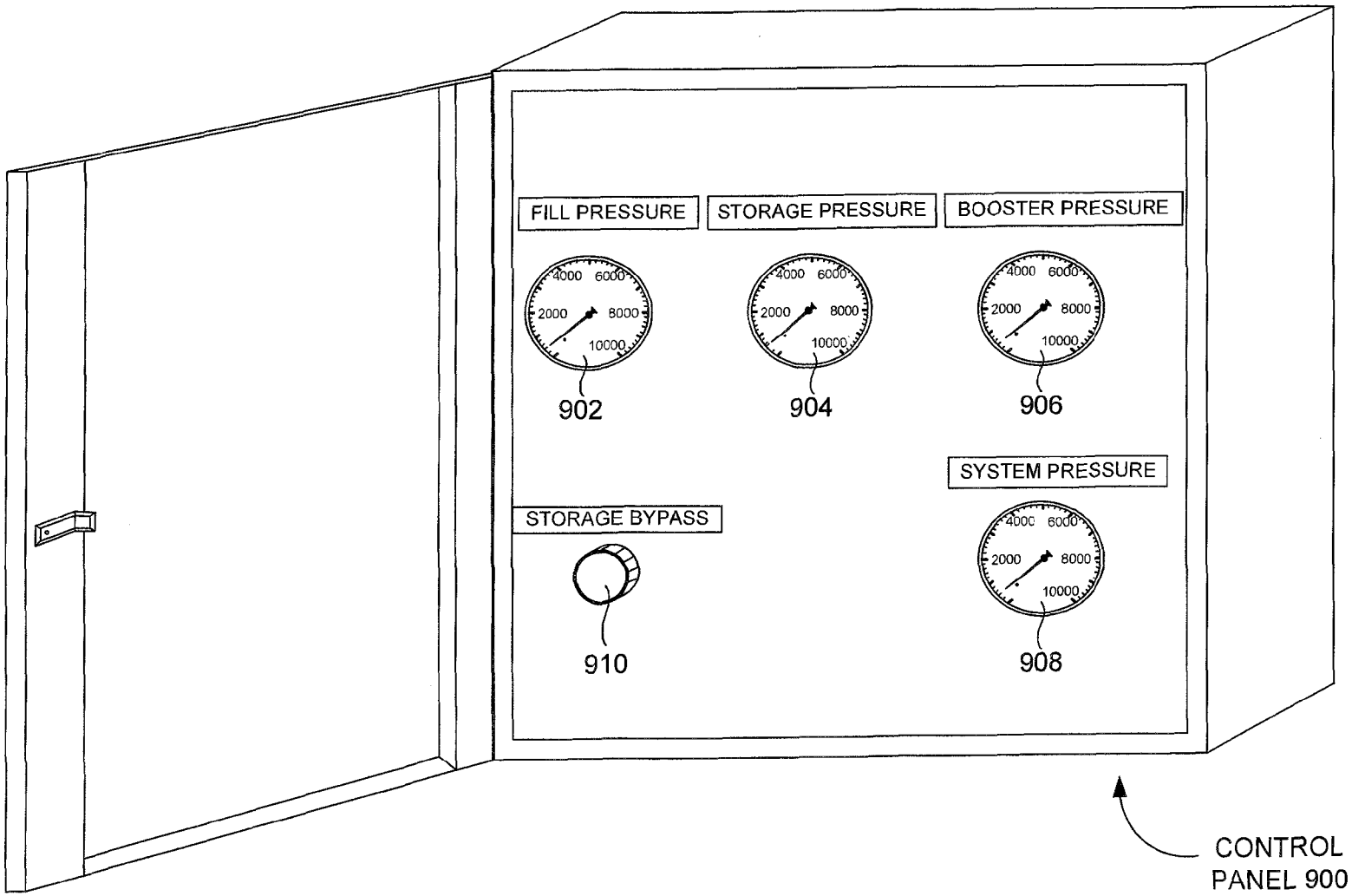
FIG. 9 is a front view of a control panel of an air storage sub-system, according to one embodiment.

FIG. 9 is a front view of a control panel 900 of an air storage sub-system 1050, according to one embodiment. The control panel 900 includes a fill pressure indicator 902, a storage pressure indicator 904, a booster pressure indicator 906, a system pressure indicator 908 and/or a storage bypass 910. The fill pressure indicator 902 may indicate the pressure level at which breathable air is being delivered by the source of compressed air to the air distribution system (e.g., an air distribution system 150, 250, and/or 350 of FIGS. 1-3). The storage pressure indicator 904 may display the pressure level of air storage tanks in the air storage sub-system 1050. The booster pressure indicator may display the pressure level of a booster cylinder. The system pressure indicator 908 may indicate the current pressure level of the breathable air in the air distribution system. Air may be directly supplied to the air distribution system (e.g., an air distribution system 150, 250, and/or 350 of FIGS. 1-3) through the storage bypass 910.

Figure 10:
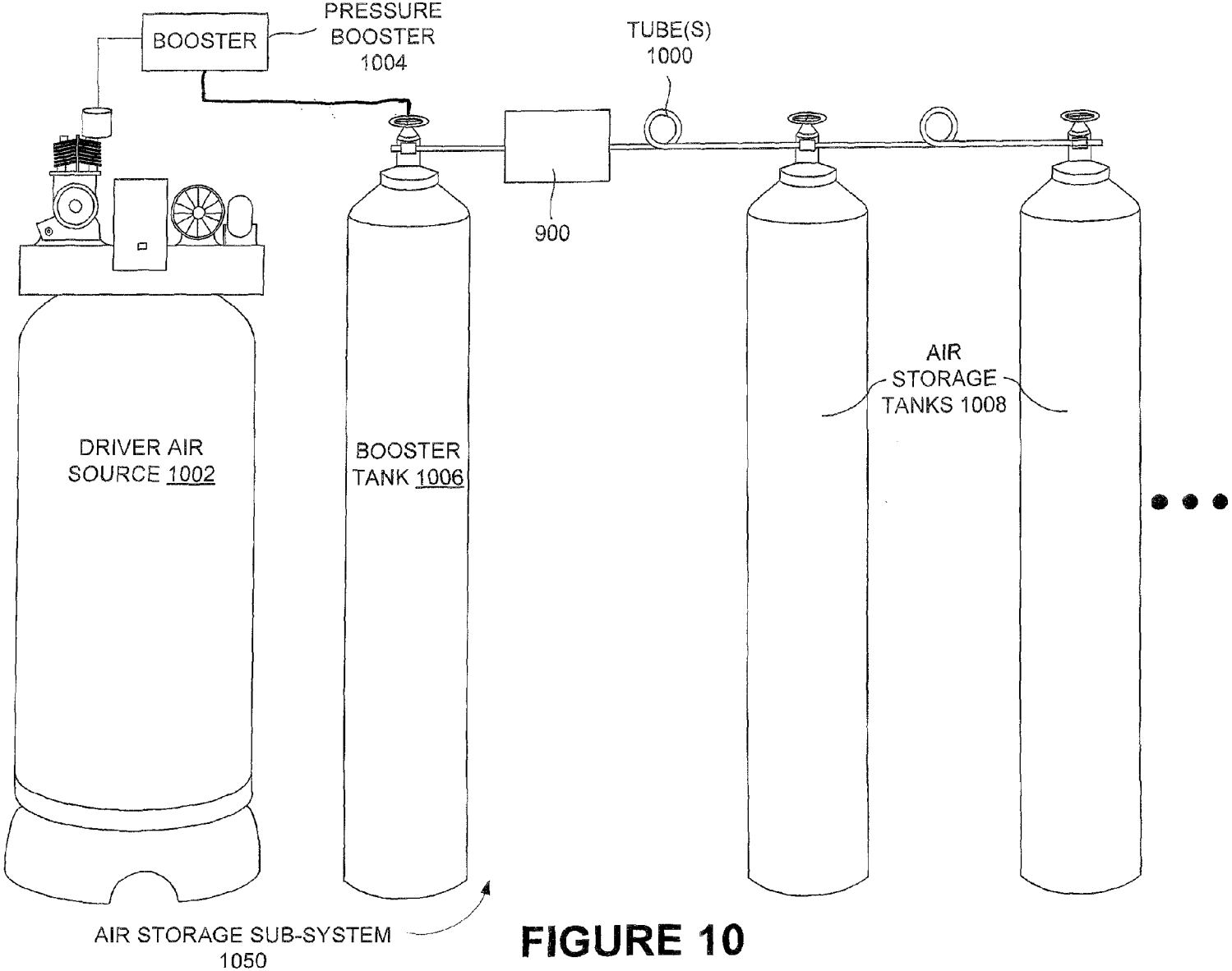
FIG. 10 is an illustration of an air storage sub-system, according to one embodiment.

FIG. 10 is an illustration of an air storage sub-system 1050, according to one embodiment. The air storage sub-system 1050 may include a control panel 900, tubes 1000, a driver air source 1002, a pressure booster 1004, a booster tank 1006, and/or any number of air storage tanks 1008. The control panel 900 may provide status information regarding the various components of the air storage sub-system 1050. The tubes 1000 may couple each air storage tank 1008 to one another in a looped configuration to increase robustness of the tubes 1000. The driver air source 1002 may be used to pneumatically drive the pressure booster 1004 to maintain a higher pressure of the air distribution system such that a breathable air apparatus is reliably filled. The booster tank 1006 may store air at a higher pressure than the air stored in the air storage tanks 1008 to ensure that the air distribution system can be supplied with air that is sufficiently pressurized to fill a breathable air apparatus.

In one embodiment, the air storage sub-system 1050 may include an air storage tanks 1008 to provide a storage of air that is dispersible to multiple locations of the building structure. The number of air storage tanks 1008 of the air storage sub-system 1050 may be coupled to each other through tubes 1000 having a looped configuration to increase robustness of the tubes 1000 through preventing breakage due to stress. In addition, a booster tank (e.g., the booster tank 1006) of the air storage sub-system 1050 may be coupled to the plurality of air storage tanks to store compressed air of a higher pressure than the compressed air that is stored in the air storage tank 1008. A driver air source 1002 of the air storage sub-system 1050 may be coupled to a pressure booster (e.g., the pressure booster 1004) to pneumatically drive a piston of the pressure booster (e.g., the pressure booster 1004) to maintain a higher pressure of the air distribution system such that a breathable air apparatus is reliably filled.

Further, the driving air source may enable the breathable air to be optimally supplied to the building structure through allowing the breathable air to be isolated from driving the pressure booster 1004. The air storage sub-system 1050 may also include an air monitoring system (e.g., the carbon monoxide sensor and moisture sensor 106 of FIGS. 1-3) to automatically track and record any of an impurity and a contaminant in the breathable air of the air distribution system. The air monitoring system 110 of FIGS. 1-3 may include an automatic shut down feature to suspend air dissemination to the fill stations (e.g., the fill station 102A of FIG. 6A) in a case that any of impurity levels and contaminant levels exceed a safety threshold. The air storage sub-system 1050 may also include a pressure monitoring system (e.g., a pressure sensor 108 of FIG. 1) to continuously track and record the system pressure of the air distribution system (e.g., the air distribution system 150, 250, 350 of FIGS. 1-3). In addition, a pressure switch may be electrically coupled to an alarm system such that the alarm system is set off when the system pressure of the air distribution system (e.g., the air distribution system 150, 250, 350 of FIGS. 1-3) is outside a safety range. The pressure switch (e.g., a pressure sensor 108 of FIG. 1) may electrically transmit a warning signal to an emergency supervising station when the system pressure of the air distribution system (e.g., the air distribution system 150, 250, 350 of FIGS. 1-3) is below the prescribed level.

The air storage sub-system 1050 may include at least one indicator unit to provide status information of the air distribution system (e.g., the air distribution system 150, 250, 350 of FIGS. 1-3) including storage pressure, booster pressure, pressure of the compressed air source, and the system pressure. Further, the air storage sub-system 1050 may also include a selector valve that is accessible by an emergency personnel to isolate the source of compressed air from the air storage sub-system such that the breathable air of the source of compressed air is directly deliverable to the fill site (e.g., the fill site 102B of FIG. 6B, and/or the fill station 102A of FIG. 6A) through the distribution structure. The air storage sub-system 1050 may be housed in a fire rated enclosure that is certified to be rupture containable to withstand elevated temperatures for a period of time.

Figure 11:
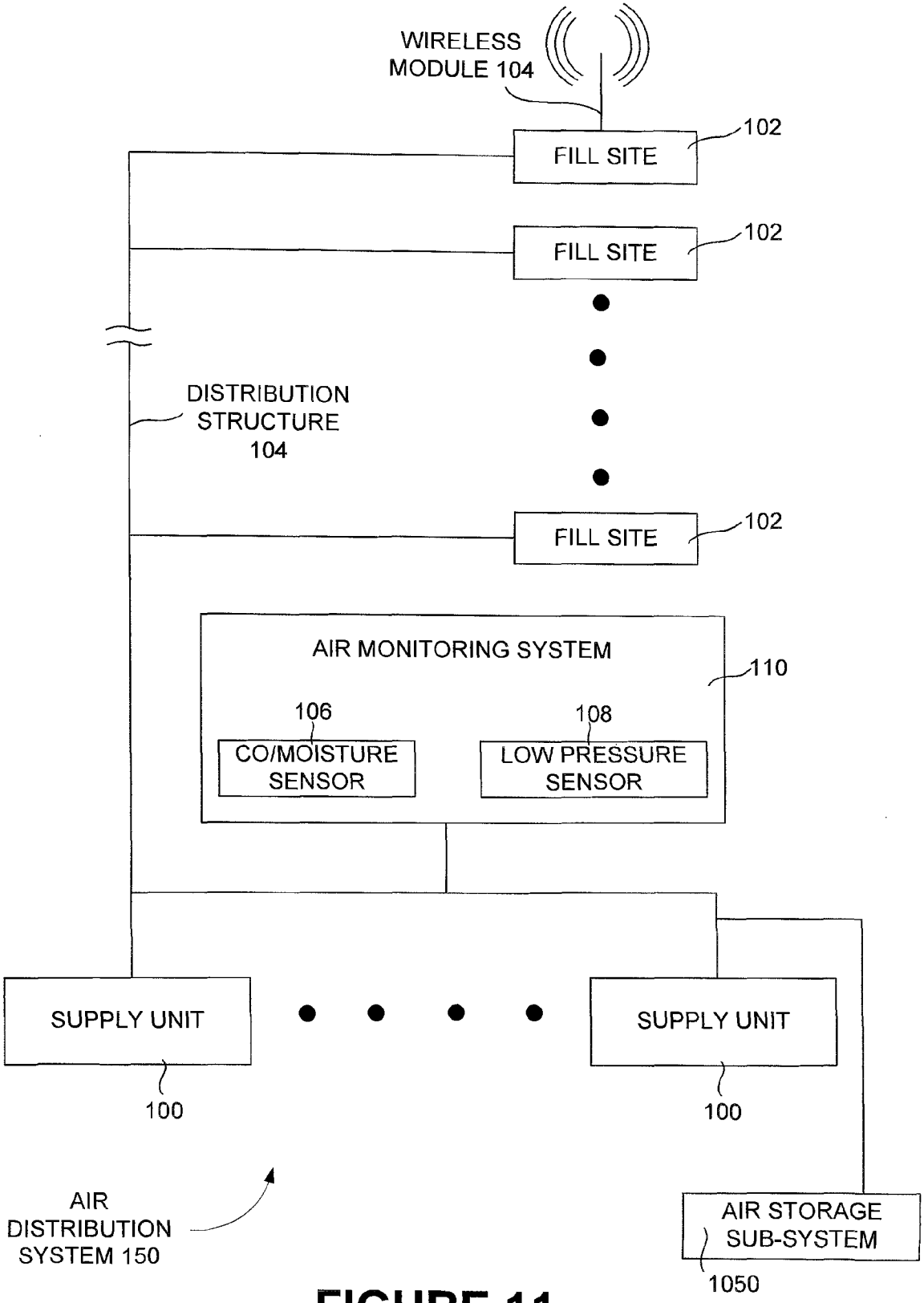
FIG. 11 is a diagram of an air distribution system having an air storage subsystem, according to one embodiment.

FIG. 11 is a diagram of an air distribution system having an air storage sub-system 1050, according to one embodiment. The air distribution system 150 may include any number of supply units 100, any number of fill sites (e.g., the fill site 102B of FIG. 6B, and/or the fill station 102A of FIG. 6A) that are coupled to the rest of the air distribution system 150 through a distribution structure 104. The air distribution system 150 may also include an air monitoring system 110 having a CO/Moisture sensor 106 and a pressure sensor 108, and/or the air storage sub-system 1050. The air storage sub-system 1050 is as previously described. Air storage tanks 1008 and/or a booster tank 1006 of the air storage sub-system 1050 of FIG. 10 may be supplied with breathable air through a source of compressed air that is coupled to the air distribution system through the supply unit 100 and/or supplied independently of the supply unit 100. The air storage sub-system 1050 may provide a spare source of breathable air to the air distribution system (e.g., the air distribution system 150, 250, 350 of FIGS. 1-3) in addition to an external source of compressed air.

Figure 12:
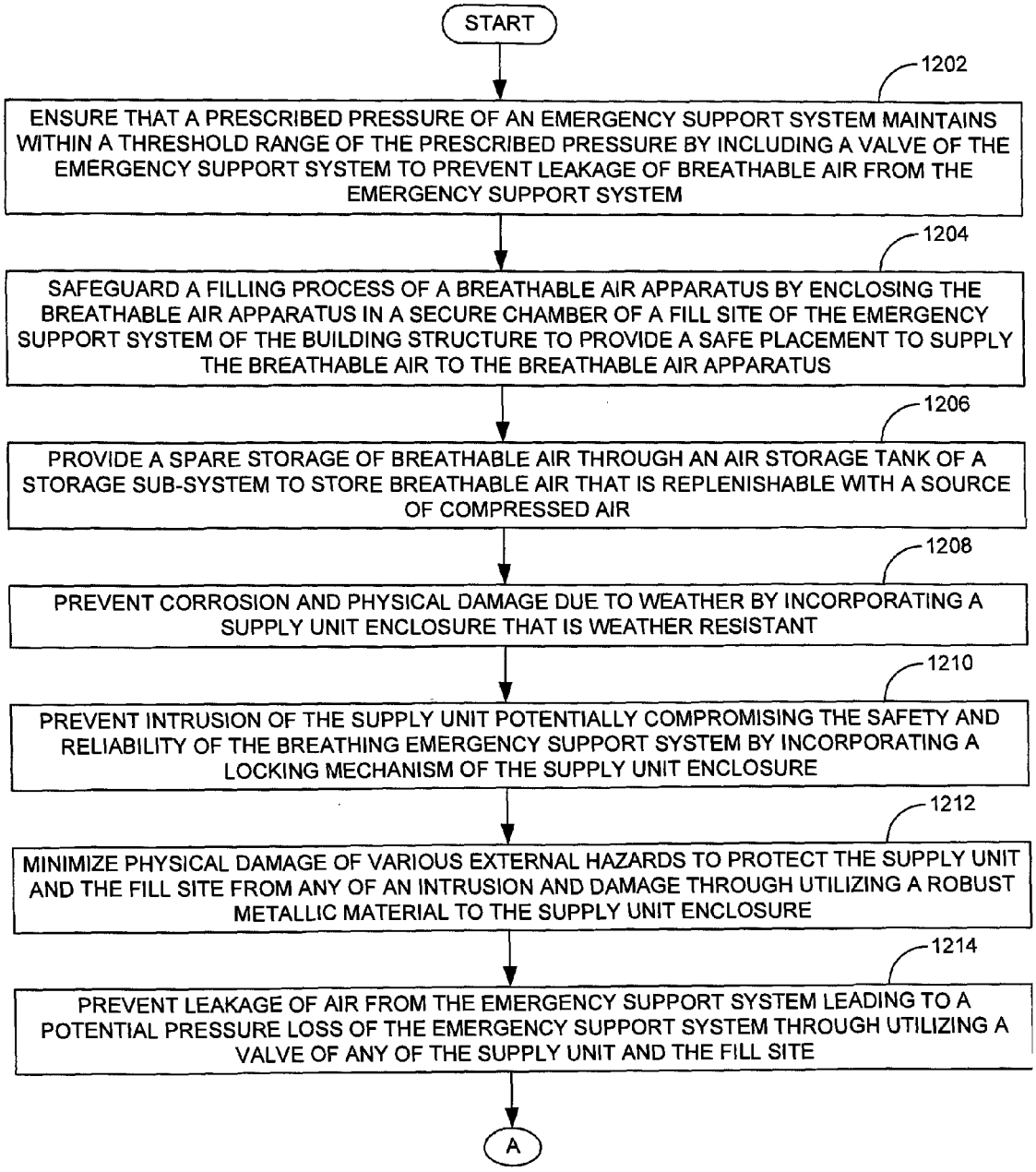
FIG. 12 is a process flow of a safety of a structure, according to one embodiment.

FIG. 12 is a process flow of a safety of a building structure, according to one embodiment. In operation 1202, a prescribed pressure of an emergency support system (e.g., the air distribution system 120, 250, 350 of FIGS. 1-3) maintains within a threshold range of the prescribed pressure may be ensured by including a valve (e.g., a valve of a series of valves 410 of FIG. 4) of the emergency support system (e.g., the air distribution system 120, 250, 350 of FIGS. 1-3) to prevent leakage of breathable air from the emergency support system (e.g., the air distribution system 120, 250, 350 of FIGS. 1-3). In operation 1204, a filling process of a breathable air apparatus may be safeguarded by enclosing the breathable air apparatus in a secure chamber of a fill site of the emergency support system (e.g., the air distribution system 120, 250, 350 of FIGS. 1-3) of the building structure to provide a safe placement to supply the breathable air to the breathable air apparatus.

In operation 1206, a spare storage of breathable air may be provided through an air storage tank (e.g., the air storage tanks 1008 of FIG. 10) of a storage sub-system to store breathable air that is replenishable with a source of compressed air. In operation 1208, corrosion and physical damage due to weather may be prevented by incorporating a supply unit enclosure (e.g., the supply unit enclosure 500 of FIG. 5)

that is weather resistant. In operation 1210, intrusion of the supply unit (e.g., a supply unit 100 of FIGS. 1-3) potentially compromising the safety and reliability of the breathing emergency support system (e.g., the air distribution system 120, 250, 350 of FIGS. 1-3) may be prevented by incorporating a locking mechanism (e.g., the locking mechanism 502 of FIG. 5) of the supply unit enclosure (e.g., the supply unit enclosure 500 of FIG. 5). In operation 1212, physical damage of various external hazards may be minimized to protect the supply unit (e.g., a supply unit 100 of FIGS. 1-3) and the fill site from any of an intrusion and damage through utilizing a robust metallic material to the supply unit enclosure (e.g., the supply unit enclosure 500 of FIG. 5). In operation 1214, leakage of air from the emergency support system (e.g., the air distribution system 120, 250, 350 of FIGS. 1-3) leading to a potential pressure loss of the emergency support system (e.g., the air distribution system 120, 250, 350 of FIGS. 1-3) may be prevented through utilizing a valve (e.g., a valve of a series of valves 410 of FIG. 4) of any of the supply unit (e.g., a supply unit 100 of FIGS. 1-3) and the fill site.

Figure 13:
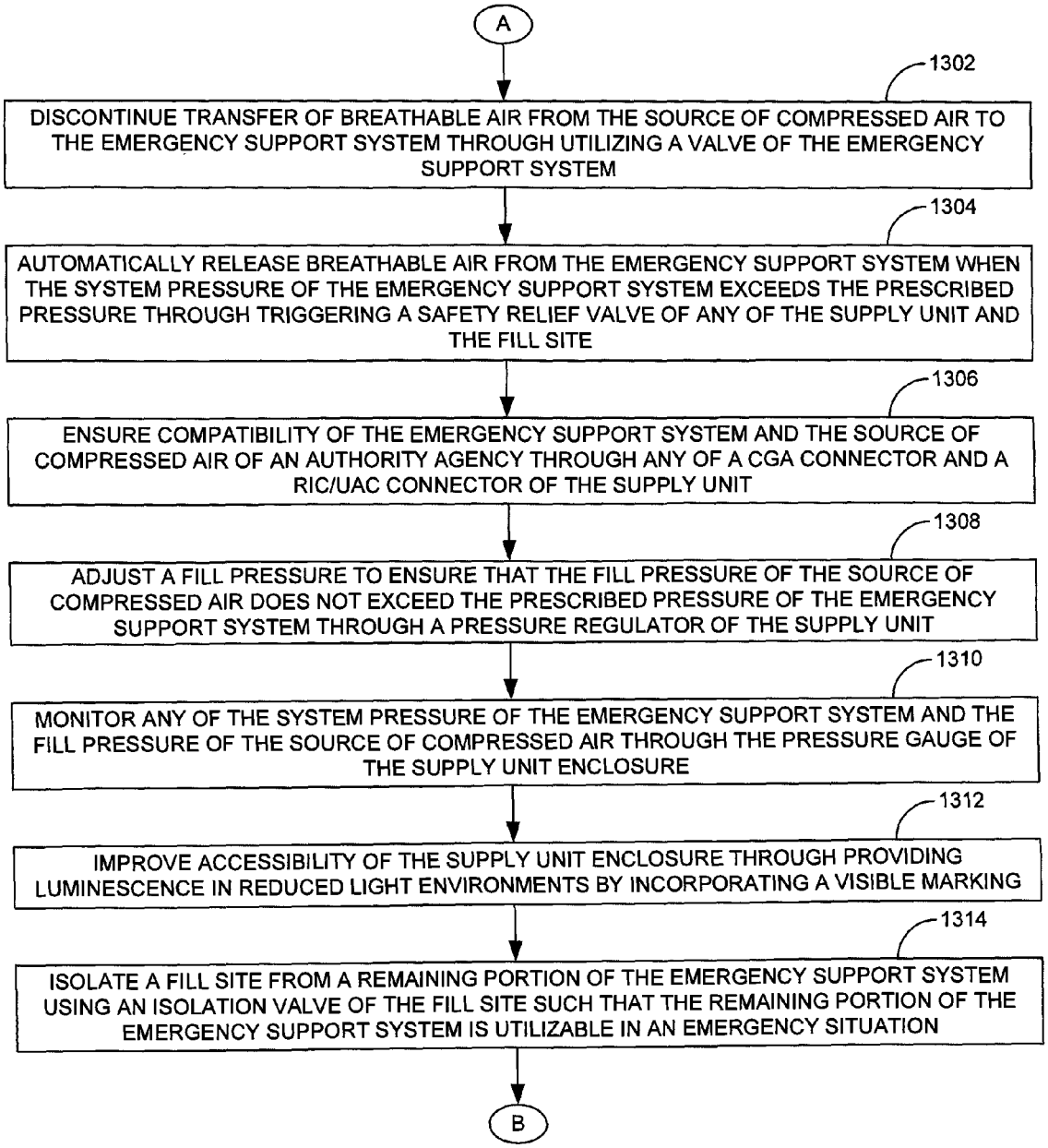
FIG. 13 is a process flow that describes further the operations of FIG. 12, according to one embodiment.

FIG. 13 is a process diagram that describes further the operations of FIG. 12, according to one embodiment. In operation 1302, transfer of breathable air from the source of compressed air to the emergency support system (e.g., the air distribution system 120, 250, 350 of FIGS. 1-3) may be discontinued through utilizing a valve (e.g., a valve of a series of valves 410 of FIG. 4) of the emergency support system (e.g., the air distribution system 120, 250, 350 of FIGS. 1-3). In operation 1304, breathable air from the emergency support system (e.g., the air distribution system 120, 250, 350 of FIGS. 1-3) may be automatically released when the system pressure of the emergency support system (e.g., the air distribution system 120, 250, 350 of FIGS. 1-3) exceeds the prescribed pressure through triggering a safety relief valve (e.g., a valve of a series of valves 410 of FIG. 4) of any of the supply unit (e.g., the supply unit 100 of FIGS. 1-3) and the fill site. In operation 1306, compatibility of the emergency support system (e.g., the air distribution system 120, 250, 350 of FIGS. 1-3) and the source of compressed air of an authority agency may be ensured through any of a CGA connector (e.g., the connector 406 of FIG. 4B) and a RIC/UAC connector of the supply unit (e.g., the supply unit 100 of FIGS. 1-3).

In operation 1308, a fill pressure may be adjusted to ensure that the fill pressure of the source of compressed air does not exceed the prescribed pressure of the emergency support system (e.g., the air distribution system 120, 250, 350 of FIGS. 1-3) through a pressure regulator of the supply unit (e.g., a supply unit 100 of FIGS. 1-3). In operation 1310, any of the system pressure of the emergency support system (e.g., the air distribution system 120, 250, 350 of FIGS. 1-3) and the fill pressure of the source of compressed air may be monitored through the pressure gauge of the supply unit enclosure (e.g., the supply unit enclosure 500 of FIG. 5). In operation 1312, accessibility of the supply unit enclosure (e.g., the supply unit enclosure 500 of FIG. 5) may be improved through providing luminescence in reduced light environments by incorporating a visible marking. In operation 1314, a fill site may be isolated from a remaining portion of the emergency support system (e.g., the air distribution system 120, 250, 350 of FIGS. 1-3) using an isolation valve of the fill site such that the remaining portion of the emergency support system (e.g., the air distribution system 120, 250, 350 of FIGS. 1-3) is utilizable in an emergency situation.

Figure 14:
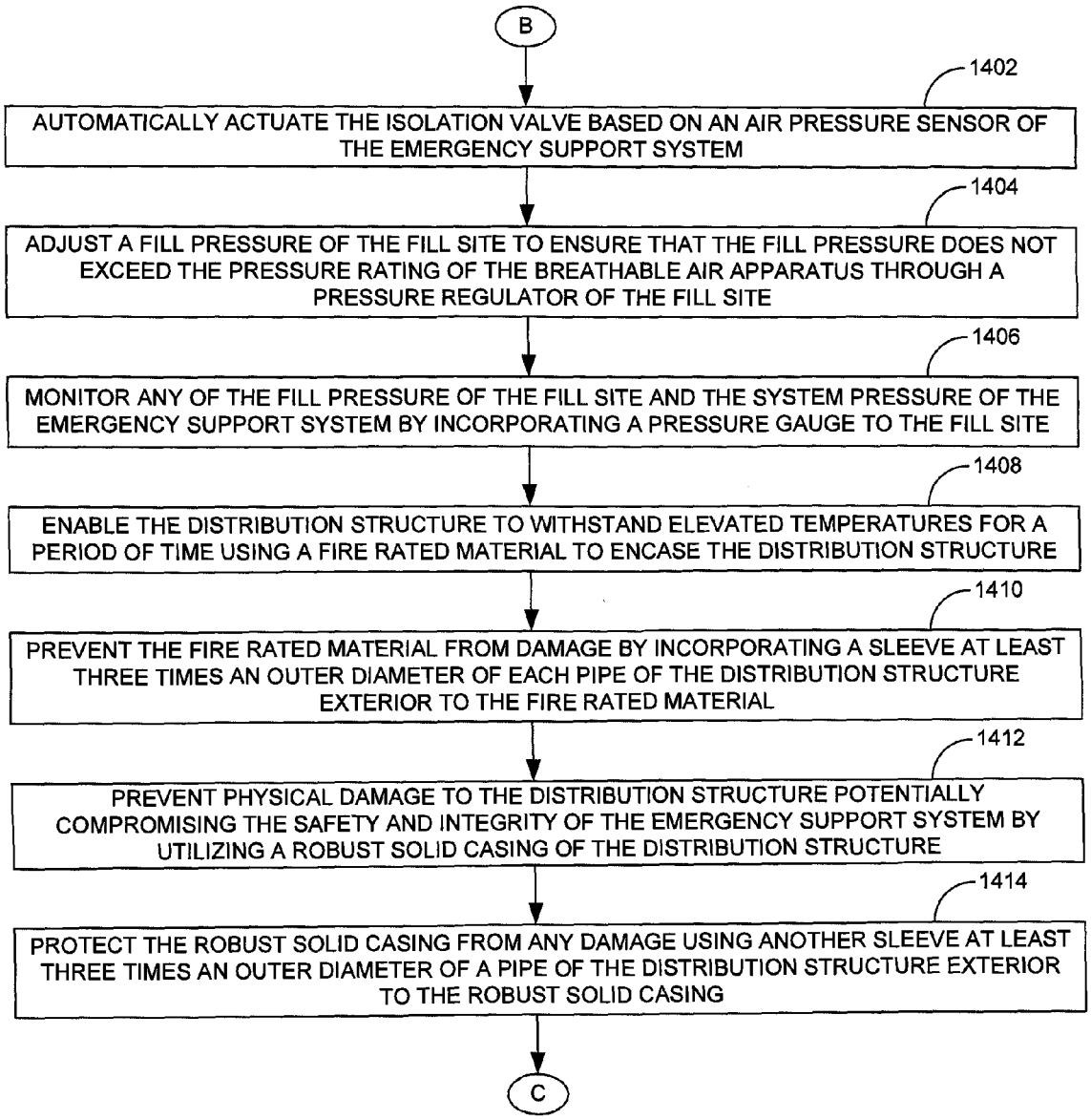
FIG. 14 is a process flow that describes further the operations of FIG. 13, according to one embodiment.

FIG. 14 is a process diagram that describes further the operations of FIG. 13, according to one embodiment. In operation 1402, the isolation valve (e.g., a valve of a series of valves 410 of FIG. 4) may be automatically actuated based on an air pressure sensor of the emergency support system (e.g., the air distribution system 120, 250, 350 of FIGS. 1-3). In operation 1404, a fill pressure of the fill site may be adjusted to ensure that the fill pressure does not exceed the pressure rating of the breathable air apparatus through a pressure regulator of the fill site. In operation 1406, any of the fill pressure of the fill site and the system pressure of the emergency support system (e.g., the air distribution system 120, 250, 350 of FIGS. 1-3) may be monitored by incorporating a pressure gauge to the fill site. In operation 1408, the distribution structure (e.g., a distribution structure 104 of FIGS. 1-3) may be enabled to withstand elevated temperatures for a period of time using a fire rated material to encase the distribution structure.

In operation 1410, the fire rated material may be prevented from damage by incorporating a sleeve at least three times an outer diameter of each pipe of the distribution structure (e.g., a distribution structure 104 of FIGS. 1-3) exterior to the fire rated material. In operation 1412, physical damage to the distribution structure (e.g., a distribution structure 104 of FIGS. 1-3) potentially compromising the safety and integrity of the emergency support system (e.g., the air distribution system 120, 250, 350 of FIGS. 1-3) may be prevented by utilizing a robust solid casing of the distribution structure (e.g., a distribution structure 104 of FIGS. 1-3). In operation 1414, the robust solid casing may be protected from any damage using another sleeve at least three times an outer diameter of a pipe of the distribution structure exterior to the robust solid casing.

Figure 15:
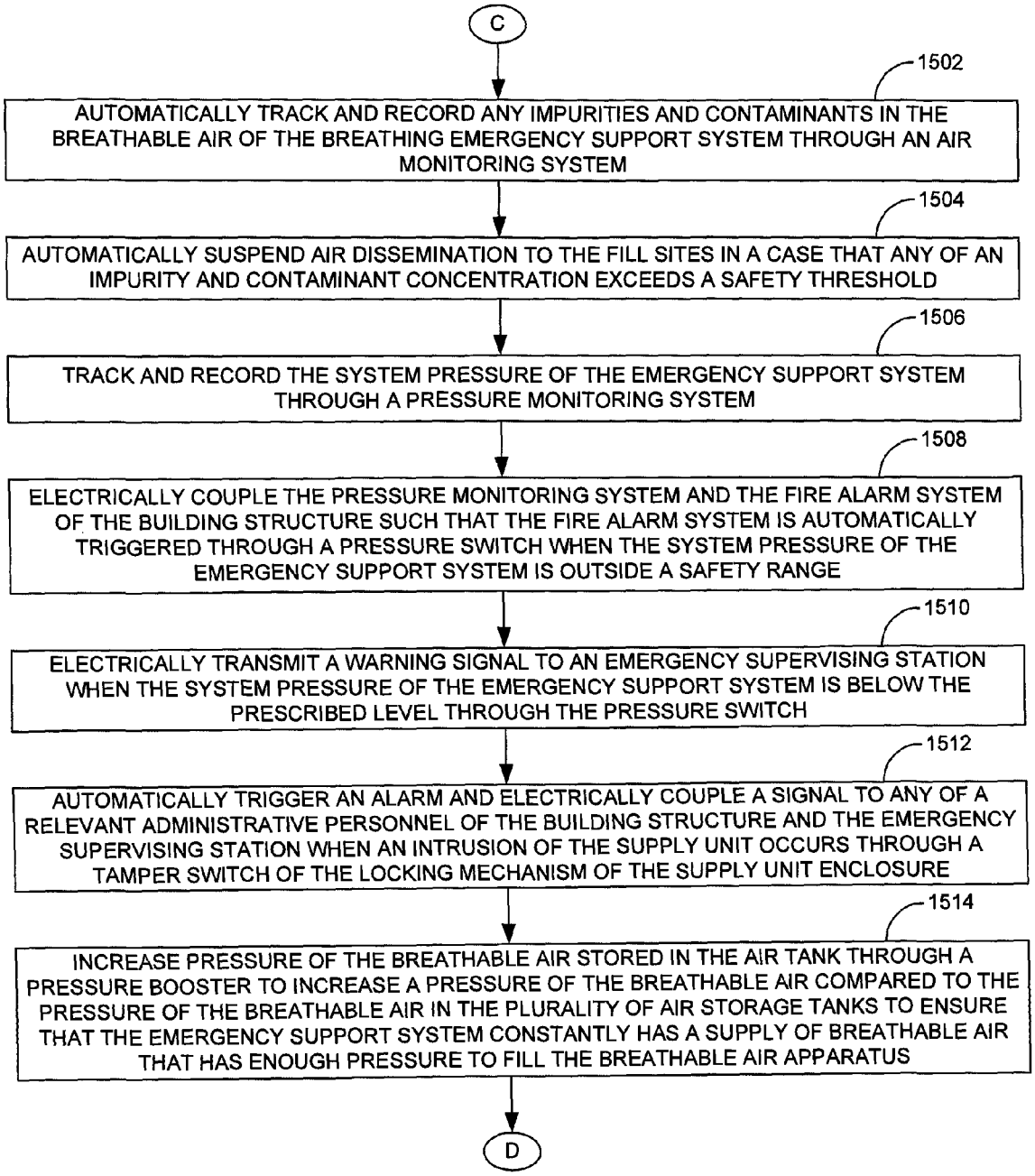
FIG. 15 is a process flow that describes further the operations of FIG. 14, according to one embodiment.

FIG. 15 is a process diagram that describes further the operations of FIG. 14, according to one embodiment. In operation 1502, any impurities and contaminants in the breathable air of the breathing emergency support system (e.g., the air distribution system 120, 250, 350 of FIGS. 1-3) may be automatically tracked and recorded through an air monitoring system (e.g., the air monitoring system 110 of FIGS. 1-3). In operation 1504, air dissemination may be suspended to the fill sites in a case that any of an impurity and contaminant concentration exceeds a safety threshold. In operation 1506, the system pressure of the emergency support system (e.g., the air distribution system 120, 250, 350 of FIGS. 1-3) may be automatically tracked and recorded through a pressure monitoring system (e.g., the air monitoring system 110 of FIGS. 1-3). In operation 1508, the pressure monitoring system (e.g., the air monitoring system 110 of FIGS. 1-3) and the fire alarm system of the building structure may be electrically coupled such that the fire alarm system is automatically triggered through a pressure switch when the system pressure of the emergency support system (e.g., the air distribution system 120, 250, 350 of FIGS. 1-3) is outside a safety range.

In operation 1510, a warning signal to an emergency supervising station may be electrically transmitted when the system pressure of the emergency support system (e.g., the air distribution system 120, 250, 350 of FIGS. 1-3) is below the prescribed level through the pressure switch. In operation 1512, an alarm may be automatically triggered and electrically couple a signal to any of a relevant administrative personnel of the building structure and the emergency supervising station when an intrusion of the supply unit (e.g., a supply unit 100 of FIGS. 1-3) occurs through a tamper switch of the locking mechanism (e.g., the locking mechanism 502 of FIG. 5) of the supply unit enclosure (e.g., the supply unit enclosure 500 of FIG. 5). In operation 1514, pressure of the breathable air stored in the air tank may be increased through a pressure booster (e.g., the pressure booster 1004 of FIG. 10) to increase a pressure of the breathable air compared to the pressure of the breathable air in the plurality of air storage tanks (e.g., the air storage tanks 1008 of FIG. 10) to ensure that the emergency support system (e.g., the air distribution system 120, 250, 350 of FIGS. 1-3) constantly has a supply of breathable air that has enough pressure to fill the breathable air apparatus.

Figure 16:
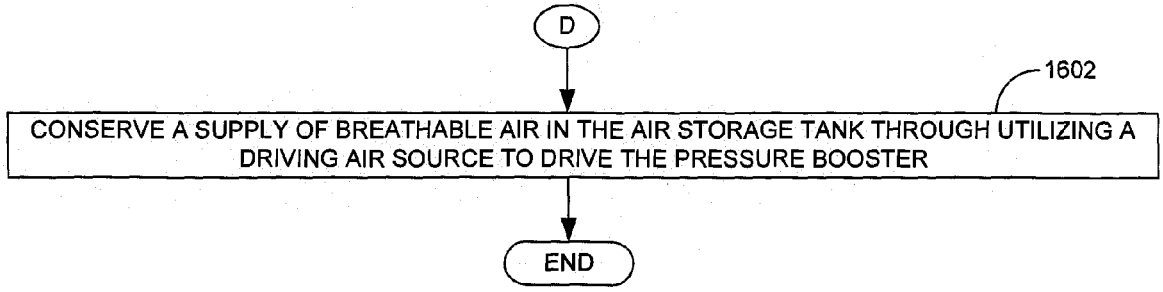
FIG. 16 is a process flow that describes further the operations of FIG. 15, according to one embodiment.

FIG. 16 is a process diagram that describes further the operations of FIG. 15, according to one embodiment. In operation 1602, a supply of breathable air in the air storage tank (e.g., the air storage tanks 1008 of FIG. 10) may be conserved through utilizing a driving air source (e.g., a driver air source 1002 of FIG. 10) to drive the pressure booster (e.g., the pressure booster 1004 of FIG. 10).

In an embodiment, a safety system of a structure may include a fill (e.g., supply, put, add, spread throughout, make full, etc.) station (e.g., a location along a route, an apparatus with special equipment, a place to load and/or unload, etc.). The fill station may include a mechanism to add air to an air tank of a Self Contained Breathing Apparatus (SCBA) unit within a secure (e.g., free from danger and/or injury, dependable, unlikely to fail, etc.) chamber (e.g., a compartment, an enclosed space, a cavity, etc.). The secure chamber may act as a safety shield (e.g., a protective barrier to prevent injury and/or avert danger, a structure to prevent escape, etc.) that confines (e.g., to close within bounds, prevent from leaving, limit, etc.) a possible rupture (e.g., explosion, fragmentation, disintegration, etc.) of an over-pressurized breathable air apparatus (e.g., a SCBA air tank, etc.) within the secure chamber.

The fill station may therefore prevent injury or death from an exploding air cylinder by using a structure that substantially encloses the air cylinder on all sides, that restricts a fill operation to when the enclosure is closed and locked, and/or that substantially prevents air tank fragments above a threshold size from emerging from the enclosure. The fill station may also include a structure that is capable of withstanding shrapnel, that uses a locking mechanism to enclose the air tank within the structure, and/or that includes a cylinder rotational mechanism allows simultaneous connection and disconnection of air cylinders while cylinders are being filled internally. The walls of the secure chamber may be made of a continuous material, welded, bolted, and/or attached in any other means required to sustain forces associated with an explosive venting of compressed gas. The secure chamber of the fill station may also be required to meet a certification standard.

An open-circuit rescue or firefighter SCBA may include various components, including a full-face mask, regulator, air cylinder, cylinder pressure gauge, and a harness with adjustable shoulder straps and waist belt that allows it be worn on a user's back. Air cylinders for SCBA may be made of aluminum, steel, and/or a composite construction (e.g., carbon-fiber wrapped.) The composite cylinders may be the lightest in weight, which may make them preferred by fire departments. However, they may also have the shortest lifespan out of various types of air cylinders, and they may be taken out of service after 15 years. The air cylinder may come in one of three standard sizes: 30, 45 or 60 minutes of breathing time. Cylinders may be filled to a standard pressure rating (e.g., 3000 psi, 4500 psi, etc.) of several thousand pounds per square inch. While many cylinders may be used repeatedly and safely with proper maintenance and inspection, some air cylinders have explosively ruptured in the past, causing injury and/or death.

Required testing may include a visual inspection in which a tank's interior is checked for corrosion, particulate, and/or any other abnormalities. The threads may be checked for integrity and/or imperfections. On aluminum tanks, a special electronic device may be used to check a cylinder's neck threads for cracking (e.g., stress cracks). An annual or more frequent inspection by an experienced technician may be needed to detect hazardous cracking before the cylinder becomes likely to fail. Untrained technicians may be unable to identify features associated with air cylinder inspections (e.g., a valley, a fold, a tap stop, etc.). Untrained technicians may also be unaware of how many threads may be safely penetrated before a cylinder must be discarded.

Air cylinders may further be required to undergo regular hydrostatic testing (e.g., every 3 years for composite cylinders, every 5 years for metal cylinders). A hydrostatic test is the common way in which leaks and/or flaws can be found in pressure vessels such as a gas cylinder. During hydrostatic testing, an air cylinder may be filled with a nearly incompressible liquid (e.g., water, oil, etc.) and examined for leaks or permanent changes in shape. Red or fluorescent dye may be usually added to the water to make leaks easier to see. The test pressure may be considerably higher than the operating pressure to give a margin for safety, typically 150% of the design pressure. For example, a cylinder rated to DOT-2015 PSI may be tested at around 3360 PSI to ensure maximum usage and to provide more safety. Water may be commonly used because it is almost incompressible, and it may only expand by a very small amount in the event of an air cylinder rupture. If high pressure gas were used, then the gas may expand to several hundred times its compressed volume in an explosion, which may cause substantial damage and/or injury, including dismemberment and/or death.

During the process of being filled with compressed air to its rated pressure (e.g., 3000 to 4500 psi), an air cylinder may become over pressurized (e.g., filled to a pressure beyond its ability to maintain structural integrity). The air cylinder may possess a reduced capacity to maintain a rated pressure due to a manufacturing defect such as an air pocket, a scratch, a dent, and/or any other imperfection that may result in a stress concentrator and/or crack initiation site. Manufacturing defects may further include materials imperfections (e.g., improperly tempered metals, impurities that make a material more brittle and/or weaker, improperly bonded and/or formed composite structures, etc.) Air cylinders may further include damage due to improper maintenance, accidental impacts, water damage, temperature induced stress, oxidation, and radiation effects. For example, structures such as air cylinders that undergo significant changes in temperature may undergo thermal stresses as different parts of the structure expand and contract. Radiation damage may include degradation of a composite bonding material. Oxidation may include rusting of a steel structure. Composite structures may undergo other forms of chemical alteration that result in a weakened structure over time. In addition, metallic structures may have a limited fatigue-failure life cycle. An air cylinder may therefore also become weakened over time through the ordinary course of wear and tear associated with aging.

Once initiated, cracks may propagate rapidly under changing stresses, such as those that occur during a filling operation. Should a rupture occur, an explosion may include a rapid multidirectional expansion of gas. Parts of an air cylinder may form shrapnel in an explosion. In a sufficiently high energy event, sheet metal may be punctured by shrapnel, doors and hinges may open, uncertified locks may become broken, and/or a person near an air cylinder that is rupturing may become seriously injured.

A fill station may therefore include a secure chamber that acts as a safety shield that confines a possible rupture of an over-pressurized breathable air apparatus (e.g., a SCBA air tank, etc.) within the secure chamber. The fill station may be rated to withstand an explosively decompressing air cylinder that has ruptured, to restrict the flow of emerging gasses to prevent harm to any nearby persons and/or equipment, and to enclose any shrapnel that may be accelerated due to an explosion. The secure chamber may be an opening within the fill station that allows filling to occur only when the structure has been closed and locked. The fill station may include a revolving structure to allow air cylinders to be mounted and unmounted while cylinders are filled within the locked secure chamber of the fill station. The revolving structure may include positions to mount two air cylinders at a time to be filled within the secure chamber. The locking mechanism may secure the revolving platform on all sides to provide sufficient support that the revolving platform will not allow shrapnel to emerge in the event of an explosion. The locking mechanism may visually indicate that the revolving structure has been secured and supported around its perimeter when the lock has been engaged.

In addition, the revolving mechanism may allow the fill station to maintain a constant pressure that fills an air tank within the secure chamber only when the locking mechanism has been engaged. In other words, unlocking the fill station may allow the filled air bottles to be disconnected from the system without a danger that air pressure will continue to be maintained in the lines connected to pressurized bottles.

Therefore, once air pressure to the system has been raised to an appropriate level (e.g., 3000 psi, 4500 psi, etc.), an operator of the fill station may add air to a cylinder by performing the steps of mounting an air cylinder to the fill station, rotating the revolving mechanism to enclose the air cylinder within the structure, and moving a lever to lock the station to allow air to flow into the air cylinders. The operator of the fill station may then move a lever to unlock the station, rotate the revolving mechanism to bring the air cylinder out from the enclosure, and unmount the filled air cylinder. Locking the fill station may provide structural support to the revolving mechanism to prevent air and shrapnel from escaping in an explosion, and may provide a visual indicator that the perimeter of the opening around the revolving mechanism has been closed. The walls of the secure chamber may be made of a continuous material, welded, bolted, and/or attached in any other means required to sustain forces associated with an explosive venting of compressed gas. The secure chamber of the fill station may also be required to meet a certification standard.

In an embodiment, a safety system of a structure may include a fill site system. A fill site system may include an apparatus that allows one or more firefighters to simultaneously refill an air tank of a Self Contained Breathing Apparatus (SCBA) unit while continuing to operate their breathing apparatus through the use of a specialized air connection (e.g., a rapid intervention company/crew (RIC) universal air connection (UAC), also described as the RIC/UAC coupling). The fill site may be a site (e.g., a location of a structure, a location within a building, etc.) to fill (e.g., supply, build up a level of, occupy the whole of, spread throughout, complete) a container with breathable air (e.g., compressed atmospheric gas meeting firefighting safety standards for quality and/or filtration) for emergency use. The specialized air connection may include a quick-connect system that allows the user to attach and/or detach the coupling without the use of a threaded connection.

In contrast, other methods and/or structures to refill an air tank of a SCBA unit may require a wearer to disconnect the air tank from the SCBA apparatus, connect the air tank to a mechanism to deliver compressed air into the air tank, and reinstall the air tank in the SCBA unit through a series of time consuming steps, during which the wearer of the SCBA unit may not have access to breathable air. The steps may involve screwing a connection together and unscrewing the connection using multiple turning actions. By allowing the wearer to continue to breathe while refilling an air tank of the SCBA unit, the wearer may avoid breathing excessive amounts of toxic, superheated and/or otherwise unbreathable air that may lead to immediate injury, long term health risks, unconsciousness, disablement, cancer, and/or death.

A SCBA unit may be a device worn by rescue workers, firefighters, industrial workers, and others to provide breathable air in a hostile environment. Areas in which SCBA may be used for industrial purposes may include mining, petrochemical, chemical, and nuclear industries. SCBA units designed for firefighting use may include components chosen for heat and flame resistance, which may add to a cost of manufacturing. Lighter materials may also be chosen to reduce the amount of effort needed by a firefighter to use the apparatus.

An open-circuit rescue or firefighter SCBA may include a full-face mask, regulator, air cylinder, cylinder pressure gauge, and a harness with adjustable shoulder straps and waist belt that allows it be worn on a user's back. Air cylinders for SCBA may be made of aluminum, steel, and/or of a composite construction (e.g., carbon-fiber wrapped.) The composite cylinders may be the lightest in weight, which may make them preferred by fire departments. However, they may also have the shortest lifespan out of various types of air cylinders, and they may be taken out of service after 15 years. Air cylinders may further be required to undergo hydrostatic testing (e.g., every 3 years for composite cylinders, every 5 years for metal cylinders). The air cylinder may come in one of three standard sizes: 30, 45 or 60 minutes of breathing time. The relative fitness, and the level of exertion of the wearer, may often result in a variation of the actual usable time that the SCBA can provide air. Working time during which a firefighter is not exposed to toxic gasses may be reduced by 25% to 50% based on these factors.

An SCBA may use a negative and/or positive pressure system to deliver breathable air. A "negative pressure" SCBA may be used with a standard face mask instead of filter canisters, and air may be delivered when the wearer breathes in, or in other words, reduces the pressure in the mask to less than external air pressure. One disadvantage of this method may be that any leaks in the device or the interface between the mask and the face of the wearer could result in a reduction of the protection offered by the SCBA. The wearer may inhale small and/or large quantities of polluted and/or toxic gas through such leaks. A "positive pressure" SCBA may be set to maintain a small positive pressure inside a face mask. Although the pressure may drop when the wearer inhales, the positive pressure SCBA may continue to maintain a higher positive pressure than external air pressure within the mask. The positive pressure may cause any leak in the mask to result, the device always maintains a higher pressure inside the mask than outside of the mask. Thus, even if the mask leaks slightly, there may be a flow of clean air out of the device that prevents inward leakage of external air.

Some potential sources of a leak in an SCBA system may be hair that prevents a complete seal of a face mask, an overly large size of a face mask, a face mask wrinkle, a face mask puncture and/or tear, a degraded seal between face mask components. Other causes of a leak may include a temporary dislocation of the face mask, such as through an accidental collision with another firefighter and/or a wall, a fall by a fatigued and/or disoriented wearer, or falling debris and/or structural components of a burning building. A wearer of the face mask may also enter a darkened building where electrical power has failed and/or been interrupted or where smoke makes it difficult for the wearer to see, which may contribute to accidental collisions. A face mask may further be dislodged by a building occupant being assisted by a firefighter.

The use of a specialized air connection (e.g., a RIC/UAC fitting and/or coupling) may allow an SCBA unit user to avoid a risk associated with breathing toxic gasses while an air cylinder is refilled by filling the SCBA unit cylinder while it is still connected to the SCBA unit as an operational source of breathable air. The RIC/UAC fitting connected to the fill site may therefore assist with expediting a breathable air extraction process from the air distribution system. The use of the specialized air connection may also avoid a risk of dislodging a user's mask and creating leaks in the SCBA system while the wearer refills an air cylinder. The specialized air connection may be a fitting designed to allow a direct transfer of air between fire fighters as a means of providing breathable air to a fire fighter without access to another means of refilling an air tank of an SCBA unit. The specialized air connection may further allow a fire fighter to provide air to a downed and/or disabled fire fighter who is unable to refill his own air tank. The specialized air connection may be a RIC/UAC coupling. The RIC/UAC coupling may allow two fire fighters with SCBA units to share their air regardless of manufacturer, after which the firefighters may have approximately equal levels of air. When a firefighter uses the RIC/UAC coupling to connect to another firefighter's SCBA unit, the pressure levels for each are balanced as air from an SCBA unit with more air flows to the connected SCBA unit.

A manufacturer of an SCBA unit may be required by the National Fire Protection Association (NFPA) 1981, the Standard on Open-Circuit Self-Contained Breathing Apparatus (SCBA) for Emergency Services, to build SCBA units that contain a RIC/UAC connection. The RIC/UAC coupling may be required for a newly manufactured SCBA unit to be in compliance for firefighting. The NFPA may be a U.S. organization that creates and maintains minimum standards and requirements for fire prevention and suppression activities, training, and equipment, as well as other life-safety codes and standards. This may include everything from building codes to the personal protective equipment utilized by firefighters while extinguishing a fire. State, local, and national governments may incorporate the standards and codes developed by the Association into their own law either directly or with only minor modifications. Even when not written into law, the Association's standards and codes may be accepted and recognized as a professional standard by a court of law.

NFPA 1981 may state in part that the RIC/UAC connection should allow a fully charged breathing air cylinder to connect to an SCBA unit of an entrapped and/or downed firefighter. The RIC/UAC coupling may be used in conjunction with a high pressure line. NFPA 1981 may further state that the pressurized air source should be able to provide 100 liters of air per minute using a RIC/UAC female fitting at a pressure compatible with the SCBA being used at an incident. NFPA 1981 may also state that, for newly manufactured SCBA, the universal connection (RIC/UAC) should be permanently fixed to the unit within four inches of the threads of the SCBA cylinder valve.

The fill site system may include variety of components to assist with expediting a breathable air extraction process from the air distribution system. For example, the fill site system may include a supply unit of a building structure to facilitate delivery of breathable air from a source of compressed air to an air distribution system of the building structure. The fill site may further include a valve to prevent leakage of the breathable air from the air distribution system potentially leading to loss of system pressure. The fill site system may further include a fill panel interior to the building structure having a RIC/UAC fitting pressure rated for a fill outlet of the fill panel to fill a breathable air apparatus to expedite a breathable air extraction process from the air distribution system and to provide the breathable air to the breathable air apparatus at multiple locations of the building structure. The system may further include a distribution structure that is compatible with use with compressed air that facilitates dissemination of the breathable air of the source of compressed air to multiple locations of the building structure.

The valve to prevent leakage of the breathable air from the air distribution system may be a part attached to a pipe and/or tube that controls the flow of a gas and/or a liquid. The valve may isolate the fill site from the remainder of the fill site system by preventing pressurized air from reaching the pressure gauge and the RIC/UAC fitting. Isolating the RIC/UAC fitting and pressure gauge may protect the parts from wear and/or possible damage due to fluctuating air pressures within the system. In addition, in the event of damage to and/or malfunction of the RIC/UAC fitting, pressure gauge and/or other connected parts, the valve may prevent the remainder of the system from venting gas through the damaged and/or malfunctioning part. The valve may be controlled by a turning knob placed in proximity to the pressure gauge to facilitate a control of the fill site station by a firefighter under hazardous conditions. Some potential causes of damage to the fill station may include a fire hazard, building damage, through a malfunction of a fire fighter's mating connection and/or SCBA unit.

The fill panel (e.g., a control panel of the fill site, a flat, vertical, area where control and/or monitoring instruments are displayed) may include gauges to monitor system air pressure and fill pressure. The valve to prevent leakage of the breathable air from the air distribution system may be controlled by a knob mounted on the fill panel. The fill panel may include a hose that is connected to the RIC/UAC fitting. The RIC/UAC fitting may be pressure rated (e.g., rated to 3000 psi, 4500 psi, etc.) for a fill outlet of the fill panel to fill a breathable air apparatus (e.g., a SCBA unit air cylinder, a SCUBA tank, etc.). The pressure rating may allow the RIC/UAC fitting to operate up to the rated pressure within a safety factor (e.g., 1.5, a multiple of the rated pressure) up to which the RIC/UAC fitting is designed and/or certified to operate.

As described above, the RIC/UAC fitting may expedite a breathable air extraction process from the air distribution system and to provide the breathable air to the breathable air apparatus. The expedited breathable air extraction process may take place at multiple locations of the building structure (e.g., different floors, hallways, near emergency exits, etc.). These locations may be near typical points where fire fighters and emergency workers may encounter while searching a building that is on fire. These locations may also be near emergency exits where building occupants are likely to pass by on their way out of a building, where they may obtain access to breathable air either directly or with the assistance of a fire fighter.

The system may further include a distribution structure that is compatible with use with compressed air that facilitates dissemination of the breathable air of the source of compressed air to multiple locations of the building structure. The distribution structure may include piping, pressure valves, and/or controls to regulate and/or direct pressurized air.

The system may include a supply unit enclosure that includes a weather resistant feature (e.g., to prevent lightning, wind, rain, and/or flooding damage, etc.). The system may include a supply unit enclosure to prevent corrosion and/or physical damage (e.g., power surges in electronic components) caused by ultraviolet, infrared, and/or other types of solar radiation (e.g., using a metallic shield, using lead, and/or a chemical coating). The system may further include a locking mechanism of the supply unit enclosure (e.g., to prevent tampering, vandalism, and/or thieves.)

The system may further include a fill panel enclosure to secure the fill panel from intrusions (e.g., due to falling building components, collisions with building occupants, etc.) that potentially compromise safety and reliability of the air distribution system. The supply unit enclosure may be comprised of 18 gauge carbon steel that minimizes physical damage due to various hazards by protecting the supply unit from intrusion and/or damage due to vehicle collisions, flooding, acid rain, snow, etc.

The system may further include a valve of the supply unit to perform any of a suspension of transfer and a reduction of flow of breathable air from the source of compressed air to the air distribution system when useful. The valve of the supply unit may therefore reduce a supply of air (e.g., an air pressure) to the distribution system when an excess pressure is provided by an external compressed air source. The valve of the supply unit may cut off an incoming air supply that fails to meet required purity standards for fire fighters. The valve may also reduce an incoming air supply that is being vented through a leak and/or malfunctioning valve of the system to prevent a waste of a compressed air source.

The system may further include a safety relief valve of any of the supply unit and the fill panel set to have an open pressure of at most approximately 10% more than a design pressure of the air distribution system to ensure reliability of the air distribution system through maintaining the system pressure such that it is within a threshold range of a pressure rating of each component of the air distribution system. The safety valve may prevent an overfilling of an air cylinder beyond its rated pressure capacity, which may cause the air cylinder to rupture. The safety valve may prevent a compressed air source from delivering air to hoses and/or fittings designed for lower pressures. The safety valve may prevent a rupture and/or other damage within the air delivery system caused by a spike in pressure. Some potential causes of a pressure spike may include a malfunctioning and/or improper pressure source, changes in temperature, and/or an explosion.

The system may further include any Compressed Gas Association (CGA) connector and/or RIC/UAC connector (rapid intervention company/crew (RIC) universal air connection (UAC)) to ensure compatibility and to facilitate a connection of the supply unit with a source of compressed air.

Although the present embodiments have been described with reference to specific example embodiments, it will be evident that various modifications and changes may be made to these embodiments without departing from the broader spirit and scope of the various embodiments. For example, the various devices, modules, analyzers, generators, etc. described herein may be enabled and operated using hardware circuitry (e.g., CMOS based logic circuitry), firmware, software and/or any combination of hardware, firmware, and/or software (e.g., embodied in a machine readable medium). For example, the various electrical structure and methods may be embodied using transistors, logic gates, and electrical circuits (e.g., application specific integrated ASIC circuitry).

In addition, it will be appreciated that the various operations, processes, and methods disclosed herein may be embodied in a machine-readable medium and/or a machine accessible medium compatible with a data processing system (e.g., a computer system), and may be performed in any order. Accordingly, the specification and drawings are to be regarded in an illustrative rather than a restrictive sense.

The above disclosed invention may be made in different manufacturing environments and/or may be used in different industrial applications. For example, the different components such as pressure gauges, air storage tanks, hose pipe, breathable air apparatus, CGA connector, RIC/UAC connector, respiratory mask, valves which constitute a breathable air safety system may be manufactured in one or more manufacturing environments and/or may be assembled at a location to build the breathable air safety system having an air storage sub-system.

With regard to usage, the breathable air safety system may be used, for example, in multiple types of structures to facilitate efficient delivery of breathable air in case of an emergency situation. Such structures include, but are not limited to, buildings, mines, tunnels, etc. Whereas many alterations and modifications of the embodiments will no doubt become apparent to a person of ordinary skill in the art after having read the foregoing description, it is to be understood that the particular embodiments shown and described by way of illustration are in no way intended to be considered limiting.

By way of example, although efficiently providing breathable air in case of emergency situation through the breathable air safety system is one particularly useful application, it is to be appreciated that the scope of the present teachings is not limited to providing breathable air to the emergency personnel, but rather can include storing the breathable air in an air storage sub-system, maintaining a prescribed pressure in the emergency support system, tracking impurities and contaminants in the breathable air, safeguarding a filling process before dispersing the breathable air at multiple locations of the structure.

Those skilled in the art may understand that the breathable air safety system may be used in conjunction with one or more systems, that may depend upon particular architectural style of the structure in a manner that provides efficient access to the breathable air of the air distribution system reliably and is not limited to the vertical and horizontal position of the structure as mentioned in above embodiments. Thus, references to the details of the described embodiments are not intended to limit their scope.

What is claimed is:

1. A safety system of a structure, comprising:

a supply unit of a structure to facilitate delivery of breathable air from a source of compressed air to an air distribution system of the structure;

a valve to prevent leakage of the breathable air from the air distribution system;

a fill station interior to the structure to provide the breathable air to at least one breathable air apparatus at multiple locations of the structure;

a distribution structure that is compatible for use with the compressed air that facilitates dissemination of the breathable air to the multiple locations of the structure; and an air storage sub-system comprising:

a pressure booster; and a driving air source to pneumatically drive a piston of the pressure booster to maintain a pressure of the air distribution system higher than a pressure of the source of compressed air such that the breathable air apparatus is capable of being reliably filled, wherein the driving air source enables the breathable air to be optimally supplied to the structure through allowing the breathable air to be isolated from driving the pressure booster.

2. The safety system of claim 1, further comprising:

an air storage tank of the air storage sub-system to provide storage of the breathable air that is dispersible to the multiple locations of the structure.

3. The safety system of claim 1, further comprising a secure chamber of the fill station as a safety shield configured to confine a possible rupture of an over-pressurized breathable air apparatus within the secure chamber, the secure chamber being certified to be rupture containable according to approved standards.

4. The safety system of claim 3, wherein the secure chamber of the fill station comprises a securing mechanism including a locking function that is configured to be automatically actuated via a coupling mechanism with a flow switch that indicates a status of air flow to the breathable air apparatus of the fill station.

5. The safety system of claim 1, wherein the structure is at least one of a building structure, a mine structure, and a tunnel structure.

6. The safety system of claim 5, wherein the building structure comprises a first set of walls extending vertically and horizontally enclosing an area of land such that the area of land is in an internal region thereof, and a second set of walls that divides the internal region of the building structure in one of a horizontal and vertical direction into rooms displaced one of horizontally and vertically from one another, the supply unit being adjacent to a particular wall of the first set of walls to facilitate delivery of breathable air from the source of compressed air to an emergency support system of the building structure.

7. The safety system of claim 1, wherein the air storage sub-system further comprises a plurality of air storage tanks to provide storage of the breathable air, the air storage tanks being coupled to each other through tubes having a looped configuration to increase robustness thereof through preventing breakage due to stress.

8. The safety system of claim 1, wherein the air storage sub-system further comprises a booster tank coupled to the pressure booster to store compressed air of a higher pressure than the source of compressed air.

9. The safety system of claim 1, further comprising a pressure monitoring system to continuously track and record a system pressure of the air distribution system.

10. The safety system of claim 9, further comprising a pressure switch electrically coupled to an alarm system such that the alarm system is set off when the system pressure of the air distribution system is outside a safety range, the pressure switch being configured to electrically transmit a warning signal to an emergency supervising station when the system pressure of the air distribution system is outside the safety range.

11. The safety system of claim 1, further comprising an air monitoring system to automatically track and record at least one of an impurity and a contaminant in the breathable air of the air distribution system, the air monitoring system including an automatic shut down feature to suspend air dissemination to the structure when at least one of: impurity levels and contaminant levels exceed a safety threshold.

12. The safety system of claim 1, wherein the air storage sub-system further comprises at least one indicator unit to provide status information of the air distribution system, the status information including at least one of: a storage pressure, a booster pressure, a pressure of the source of compressed air, and a system pressure.

13. The safety system of claim 1, further comprising at least one of:

a supply unit enclosure encompassing the supply unit having at least one of a weather resistant feature and an ultraviolet and infrared solar radiation resistant feature to prevent corrosion and physical damage;

a locking mechanism of the supply unit enclosure to secure the supply unit from intrusions thereon;

a metallic material of the supply unit enclosure to minimize a physical damage associated with a hazard to protect the supply unit from at least one of an intrusion and damage, the metallic material being substantially at least 18 gauge carbon steel;

at least one pressure gauge of the supply unit to indicate at least one of a system pressure of the air distribution system and a fill pressure of the source of compressed air; and a tamper switch of the locking mechanism of the supply unit enclosure to enable automatic triggering of an alarm such that a signal is electrically coupled to at least one of relevant administrative personnel of the structure and an emergency supervising station when an intrusion of the supply unit occurs.

14. The safety system of claim 13, further comprising a visible marking of the supply unit enclosure and a fill station enclosure to provide luminescence in a reduced light environment.

15. The safety system of claim 1, further comprising at least one of:

a valve of the supply unit to automatically suspend transfer of breathable air from the source of compressed air to the air distribution system when required; and a selector valve accessible by emergency personnel to selectively utilize the source of compressed air to deliver breathable air to the fill station.

16. The safety system of claim 1, further comprising at least one of:

a safety relief valve of at least one of the supply unit and the fill station to release the breathable air when a system pressure of the air distribution system exceeds a threshold pressure to ensure reliability of the air distribution system through maintaining the system pressure within a pressure rating of each component of the air distribution system.

17. The safety system of claim 1, further comprising at least one of a CGA connector and a RIC/UAC connector of the supply unit to facilitate a connection with the source of compressed air through ensuring compatibility therewith.

18. The safety system of claim 1, wherein the supply unit further comprises an adjustable pressure regulator used to adjust a fill pressure of the source of compressed air to ensure that the fill pressure does not exceed a design pressure of the air distribution system.

19. The safety system of claim 1, further comprising at least one of:

a fill station valve of the fill station to prevent leakage of air from the air distribution system through ensuring that the system pressure is maintained within a threshold range of the design pressure to reliably fill the breathable air apparatus; and at least one pressure regulator of the fill station to adjust a fill pressure to fill the breathable air apparatus and to ensure that the fill pressure does not exceed a pressure rating of the breathable air apparatus.

20. The safety system of claim 1, further comprising an isolation valve of the fill station to isolate the fill station from a remaining portion of the air distribution system, the isolation valve being configured to be automatically actuated based on an air pressure sensor of the air distribution system.

21. The safety system of claim 1, further comprising at least one pressure gauge of the fill station to indicate at least one of: a fill pressure of the fill station and a system pressure of the air distribution system.

22. The safety system of claim 1, further comprising at least one of:

at least one of a fire rated material and a fire rated assembly to enclose the distribution structure such that the distribution structure possesses an ability to withstand elevated temperatures for a prescribed period of time; and a sleeve that is at least three times an outer diameter of each of a plurality of pipes of the distribution structure exterior to the fire rated material to further protect the fire rated material from damage, both ends of the sleeve being fitted with the fire rated material, and the fire rated material being approved by an authority agency.

23. The safety system of claim 1, further comprising at least one of:

a solid casing of the distribution structure to prevent physical damage to the distribution structure; and sleeve at least three times an outer diameter of a pipe of the distribution structure exterior to the solid casing to further protect the solid casing from damage, both ends of the another sleeve being fitted with a fire rated material, and the fire rated material being approved by an authority agency.

24. The safety system of claim 1, further comprising:

a plurality of support structures of the distribution structure at intervals no larger than five feet to provide adequate structural support for a remainder of the distribution structure, the distribution structure comprising at least one of a stainless steel and a thermoplastic material compatible for use with the compressed air.

25. The safety system of claim 1, wherein the fill station has a physical capacity to enclose at least one breathable air apparatus and includes an RIC/UAC connector to expedite a filling process of the breathable air apparatus.

26. The safety system of claim 1, wherein the air storage sub-system is housed in a fire rated enclosure certified to be rupture containable to withstand elevated temperatures for a prescribed amount of time.

* * * * *